US009995307B2

(12) United States Patent
Dooley et al.

(10) Patent No.: US 9,995,307 B2
(45) Date of Patent: Jun. 12, 2018

(54) TWO-WAY FLOW CONTROL DEVICE, ASSOCIATED SYSTEMS AND METHODS

(71) Applicant: Kevin Allan Dooley Inc., Toronto (CA)

(72) Inventors: Kevin Allan Dooley, Toronto (CA); Elwood A Morris, Nanaimo (CA)

( * ) Notice: Subject to any disclaimer, the term of this patent is extended or adjusted under 35 U.S.C. 154(b) by 0 days. days.

(21) Appl. No.: 15/537,487

(22) PCT Filed: Feb. 10, 2015

(86) PCT No.: PCT/CA2015/050094
§ 371 (c)(1),
(2) Date: Jun. 19, 2017

(87) PCT Pub. No.: WO2016/127241
PCT Pub. Date: Aug. 18, 2016

(65) Prior Publication Data
US 2018/0003184 A1 Jan. 4, 2018

(51) Int. Cl.
*F04D 27/00* (2006.01)
*F04D 29/36* (2006.01)
(Continued)

(52) U.S. Cl.
CPC ..... *F04D 27/002* (2013.01); *F04D 27/001* (2013.01); *F04D 29/36* (2013.01);
(Continued)

(58) Field of Classification Search
CPC ..... F04D 27/002; F04D 27/001; F04D 29/36; F04D 29/382; F04D 29/544; F04D 29/665
See application file for complete search history.

(56) References Cited

U.S. PATENT DOCUMENTS 7,471,009 B2 * 12/2008 Davis ..... F03B 3/128 290/43
8,022,567 B2 * 9/2011 Davis ..... F03B 3/128 290/54
(Continued)

FOREIGN PATENT DOCUMENTS

| | | |
|---|---|---|
| CA | 2883308 | 2/2015 |
| WO | 2010135484 | 11/2010 |
| WO | 2013153052 | 10/2013 |

OTHER PUBLICATIONS

International Search Report and Written Opinion for corresponding PCT Patent Application No. PCT/CA2015/050094 dated Oct. 30, 2015.
(Continued)

*Primary Examiner* — Justin Seabe
*Assistant Examiner* — Behnoush Haghighian
(74) *Attorney, Agent, or Firm* — William J. Clemens; Shumaker, Loop & Kendrick, LLP

(57) ABSTRACT

A two-way flow control device including: a housing defining a first opening interface and a second opening interface, a rotor having a plurality of blades, each blade controllable to be angled in a range of positive and negative blade angles to generate respective positive and negative flows between the first opening interface and the second opening interface, first stator vanes mounted to the housing between the blades and the first opening interface, each including a respective stator vane slope having a stator vane angle which are collectively positive or negative angled; second stator vanes mounted to the housing between the blades and the second opening interface, each including a respective stator vane slope having a stator vane angle which are collectively opposite angled to the stator vane angles of the first stator vanes, the
(Continued)

second stator vanes mounted to be circumferentially offset with respect to the first stator vanes.

21 Claims, 32 Drawing Sheets

(51) Int. Cl.
*F04D 29/38* (2006.01)
*F04D 29/66* (2006.01)
*F04D 29/54* (2006.01)

(52) U.S. Cl.
CPC ..... *F04D 29/382* (2013.01); *F04D 29/544* (2013.01); *F04D 29/665* (2013.01)

(56) References Cited

U.S. PATENT DOCUMENTS 8,596,955 B2 * 12/2013 Freeman ..... F01D 1/02 415/3.1
8,596,956 B2 12/2013 Chir et al.
8,875,511 B2 * 11/2014 Simpson ..... F24J 3/08 290/44
9,109,614 B1 * 8/2015 Fong ..... F15B 21/042
9,443,505 B2 * 9/2016 Dooley ..... G05D 19/02
9,765,753 B2 * 9/2017 Freeman ..... F01D 1/02
2009/0263238 A1 * 10/2009 Jarrah ..... F04D 29/544 415/199.5
2013/0099496 A1 * 4/2013 Solheim ..... B63B 21/50 290/44
2014/0284932 A1 * 9/2014 Sharkh ..... F03B 13/105 290/54
2016/0319845 A1 * 11/2016 Molnar ..... F04D 29/668

OTHER PUBLICATIONS

Office Action dated Jul. 25, 2016 for corresponding Canadian Patent Application No. 2,923,498.
Office Action dated Sep. 23, 2016 for corresponding Canadian Patent Application No. 2,923,498.
Notice of Allowance dated Nov. 2, 2016 for corresponding Canadian Patent Application No. 2,923,498.

* cited by examiner

Graph from McCauley et al. 1976

TWO-WAY FLOW CONTROL DEVICE, ASSOCIATED SYSTEMS AND METHODS

TECHNICAL FIELD

Example embodiments generally relate to flow control devices, such as compressors or pressure fluctuation generators, and related systems and methods.

BACKGROUND

For some circulating devices such as fans, pumps, rotary vanes, and compressors, guide members or housing shapes may be used to direct flow of the air or circulating medium to or from the rotors. However, the shape, configuration, and/or orientation of these guide members typically would be designed for flow considerations in one direction only, for example.

Additional difficulties with existing systems may be appreciated in view of the Detailed Description of Example Embodiments, below.

SUMMARY

In an example embodiment, there is provided a two-way flow control device, including: a housing defining a first opening interface and a second opening interface; a rotor for rotating within the housing; a plurality of blades each mounted to the rotor, each blade controllable to be angled in a range of positive and negative blade angles to generate respective positive and negative flows between the first opening interface and the second opening interface; a first plurality of stator vanes mounted to the housing between the blades and the first opening interface, each including a respective stator vane slope having a stator vane angle which are collectively positive or negative angled; a second plurality of stator vanes mounted to the housing between the blades and the second opening interface, each including a respective stator vane slope having a stator vane angle which are collectively opposite angled to the stator vane angles of the first plurality of stator vanes, the second plurality of stator vanes mounted to be circumferentially offset with respect to the first plurality of stator vanes, wherein the first and second plurality of stator vanes further guide both the positive and negative flows.

In an example embodiment, at least one or all of the stator vanes includes a respective concave surface which includes the respective stator vane slope. In an example embodiment, the stator vanes further include a convex surface at an opposite face to the respective concave surface. In an example embodiment, at least one of the respective stator vanes are canted towards the rotor.

In an example embodiment, the first plurality of stator vanes comprise generally mirror image shapes of the second plurality of stator vanes.

In an example embodiment, the first and second plurality of stator vanes are statically mounted to the housing to maintain the respective stator vane angle.

In an example embodiment, at least one controller is configured to control the blade angle of the blades at a specified frequency or frequencies.

BRIEF DESCRIPTION OF THE DRAWINGS

Reference will now be made, by way of example, to the accompanying drawings which show example embodiments, in which.

Similar reference numerals may be used in different figures to denote similar components.

DETAILED DESCRIPTION OF EXAMPLE EMBODIMENTS

Figure 1:
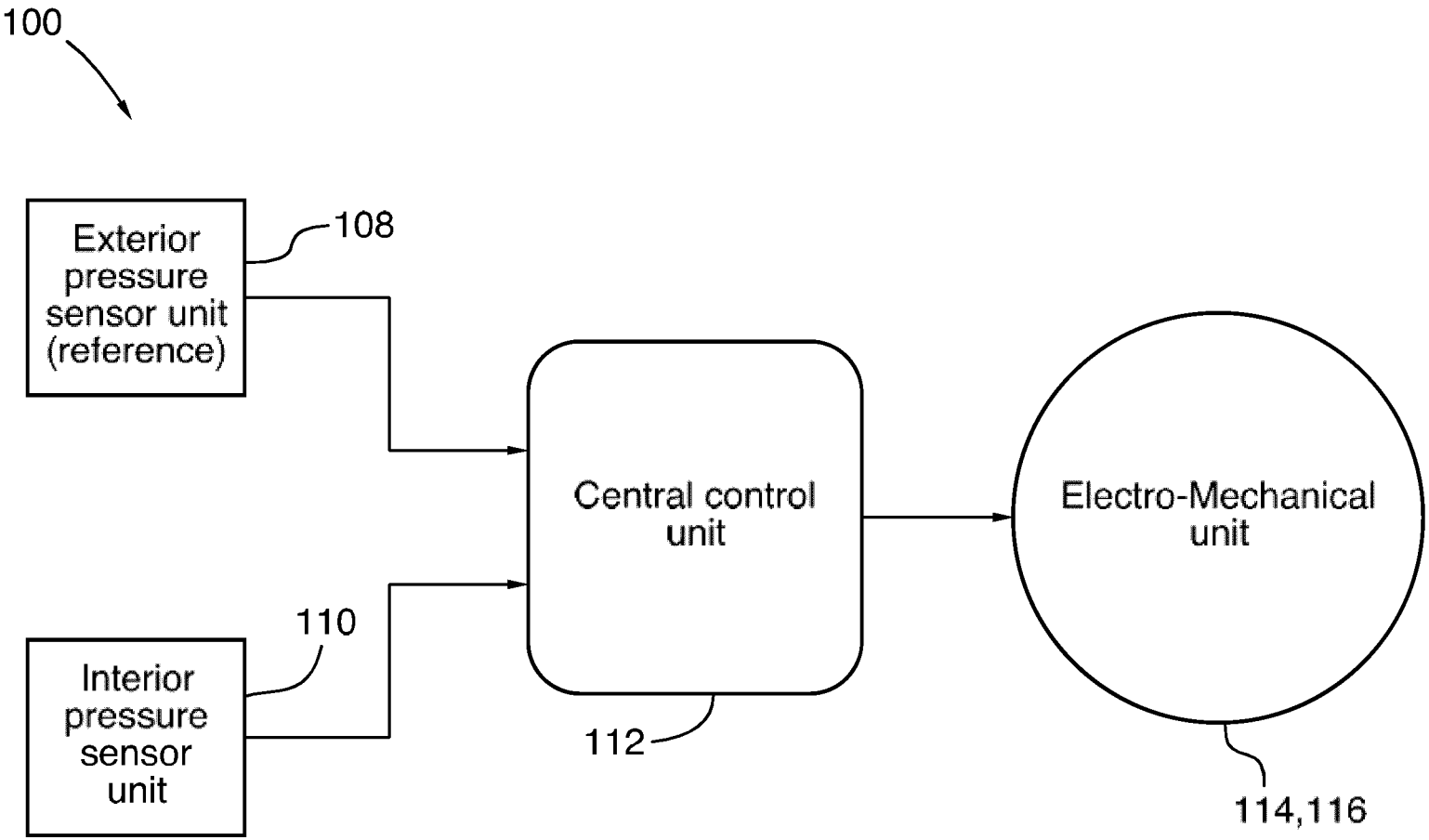
FIG. 1 illustrates a block diagram of a system configured to control infrasonic pressure fluctuations (infrasound) inside a structure, in accordance with an example embodiment.

In an example embodiment, there is provided a two-way flow control device, including: a housing defining a first opening interface and a second opening interface; a rotor for rotating within the housing; a plurality of blades each mounted to the rotor, each blade controllable to be angled in a range of positive and negative blade angles to generate respective positive and negative flows between the first opening interface and the second opening interface; a first plurality of stator vanes mounted to the housing between the blades and the first opening interface, each including a respective stator vane slope having a stator vane angle which are collectively positive or negative angled; a second plurality of stator vanes mounted to the housing between the blades and the second opening interface, each including a respective stator vane slope having a stator vane angle which are collectively opposite angled to the stator vane angles of the first plurality of stator vanes, the second plurality of stator vanes mounted to be circumferentially offset with respect to the first plurality of stator vanes, wherein the first and second plurality of stator vanes further guide both the positive and negative flows.

The Applicant has described SYSTEMS AND METHODS FOR CONTROL OF INFRASOUND PRESSURES in PCT Patent Application Serial No. PCT/CA2014/050601 filed Jun. 25, 2014, the contents of which are hereby incorporated by reference. The Applicant has described SYSTEMS AND METHODS FOR CONTROL OF MOTION SICKNESS WITHIN A MOVING STRUCTURE DUE TO INFRASOUND PRESSURES in U.S. patent application Ser. No. 14/478,468 filed Sep. 5, 2014, the contents of which are hereby incorporated by reference.

Infrasonic pressure fluctuations (infrasound) can be described as local very low frequency Barometric pressure fluctuations, and can be generated as a result of either natural or industrial processes as well as air circulation fans and also large wind turbines. Infrasound has been implicated in various issues pertaining to human health effects. For example, Sick Building Syndrome has long been connected to low frequency (inaudible) cyclic pressure fluctuations due to faulty air circulation systems. Medicinal or natural remedies have been used when occupants are feeling unwell as a result of these devices. Another conventional solution is to altogether remove the device which is causing the problem, or to move the occupant to another dwelling far away from the source.

For example, the primary purpose of a wind turbine is to generate electricity from the kinetic power of the wind, while the primary purpose of air circulation fans is to circulate hot or cool air to achieve a specified temperature. Many such industrial devices merely have these primary goals in mind. However, many such devices typically are not designed with infrasound even as a consideration.

Motion sickness can occur in a moving vehicle. For example, in McCauley et al. (Michael E McCauley, Jackson W Royal, C. Dennis Wylie, James F. O'Hanlon, Robert R. Nackie: Motion Sickness Incidence: Exploratory studies of habituation, pitch and roll, and the refinement of a mathematical model. Technical Report 1733-21976 Contract N00014-73-C-40 Apr. 1976), hereinafter "McCauley et al.", incorporated herein by reference, it was believed the predominant cause of motion sickness to be from movement frequency and acceleration. For example, it has been traditionally thought that vestibular-ocular functions (inner-ear and eye co-ordination) may be disrupted based primarily on acceleration changes, such as in the vehicle. However, merely addressing these variables may be insufficient in understanding how to address the afflictions to the passenger.

Neighbors of some types of industrial machines have previously complained of similar symptoms to that of Sick Building Syndrome, which can be traced to infrasonic pressure fluctuations (infrasound). For example, some neighbors of large wind turbine installations appear to be suffering with similar symptoms in their homes following the installation and operation of large wind turbine generators. Measurements and remediation measures in both industrial and sick building situations indicate that cyclic infrasonic pressure fluctuations can be a contributing cause of these symptoms.

It may be advantageous to provide a method of controlling undesired infrasonic pressure fluctuations in structures which are occupied by affected people, without requiring expensive or impractical modification or elimination of the systems generating the infrasound.

In an example embodiment, there is provided a system having an electronically controlled reversible compressor, which is installed between the exterior and interior of a structure such as a dwelling. The reversibility of the compressor flow direction is such that the flow through the compressor is fully controllable from zero to plus or minus a controlled flow rate in a continuously variable fashion at rates that are at least equal to the pressure fluctuation rates arriving inside the structure. In an example embodiment, the harmonic content of the pressure fluctuations is controlled, such as the fundamental harmonic and/or higher order harmonics of the source of the pressure disruption. The system includes an electronic control system including at least one controller which operates in a closed loop such that pressure fluctuations sensed by the pressure sensing system are automatically cancelled by oppositely polarized pressures generated as a function of time by the flow rate and flow direction of the said reversible compressor by delivering air or removing air from the volume of the target structure.

In an example embodiment, there is provided a system for infrasound control of a structure defining an interior. The system includes a reversible compressor including a housing defining an interior opening interface open to the interior of the structure and an exterior opening interface open to an exterior of the structure, and including at least one controllable element to generate positive pressure flows and negative pressure flows between the interior opening interface and the exterior opening interface. The system includes a first pressure sensor located to sense pressure indicative of the interior of the structure, a second pressure sensor located to sense pressure indicative of the exterior of the structure, and at least one controller configured to control the at least one controllable element of the compressor to cancel pressure oscillations within the interior of the structure based on the pressures detected by the first pressure sensor and the second pressure sensor.

In accordance with another example embodiment, there is provided a reversible infrasonic pressure fluctuation (infrasound) generating compressor, including: a housing defining a first opening interface and a second opening interface; a rotor for rotating within the housing including a plurality of blades each having a respective magnet, the plurality of blades formed of resilient material to twist in a range of positive and negative blade angles to generate respective positive and negative airflows between the first opening interface and the second opening interface; a drive device configured to generate positive or negative current; and an electromagnet controllable by the current from the drive device and positioned to create a positive or negative magnetic field to magnetically interact with the magnets to correspondingly twist the respective blades to a corresponding positive or negative blade angle.

In accordance with another example embodiment, there is provided a method for controlling infrasonic pressure fluctuation (infrasound) of a structure defining an interior, including: determining first pressure sensor information indicative of the interior of the structure; determining second pressure sensor information indicative of an exterior of the structure; and controlling, using at least one controller, at least one controllable element of a reversible compressor which defines an interior opening interface open to the interior of the structure and an exterior opening interface open to the exterior of the structure, to cancel pressure oscillations within the interior of the structure based on the determined first and second pressure sensor information.

Figure 2:
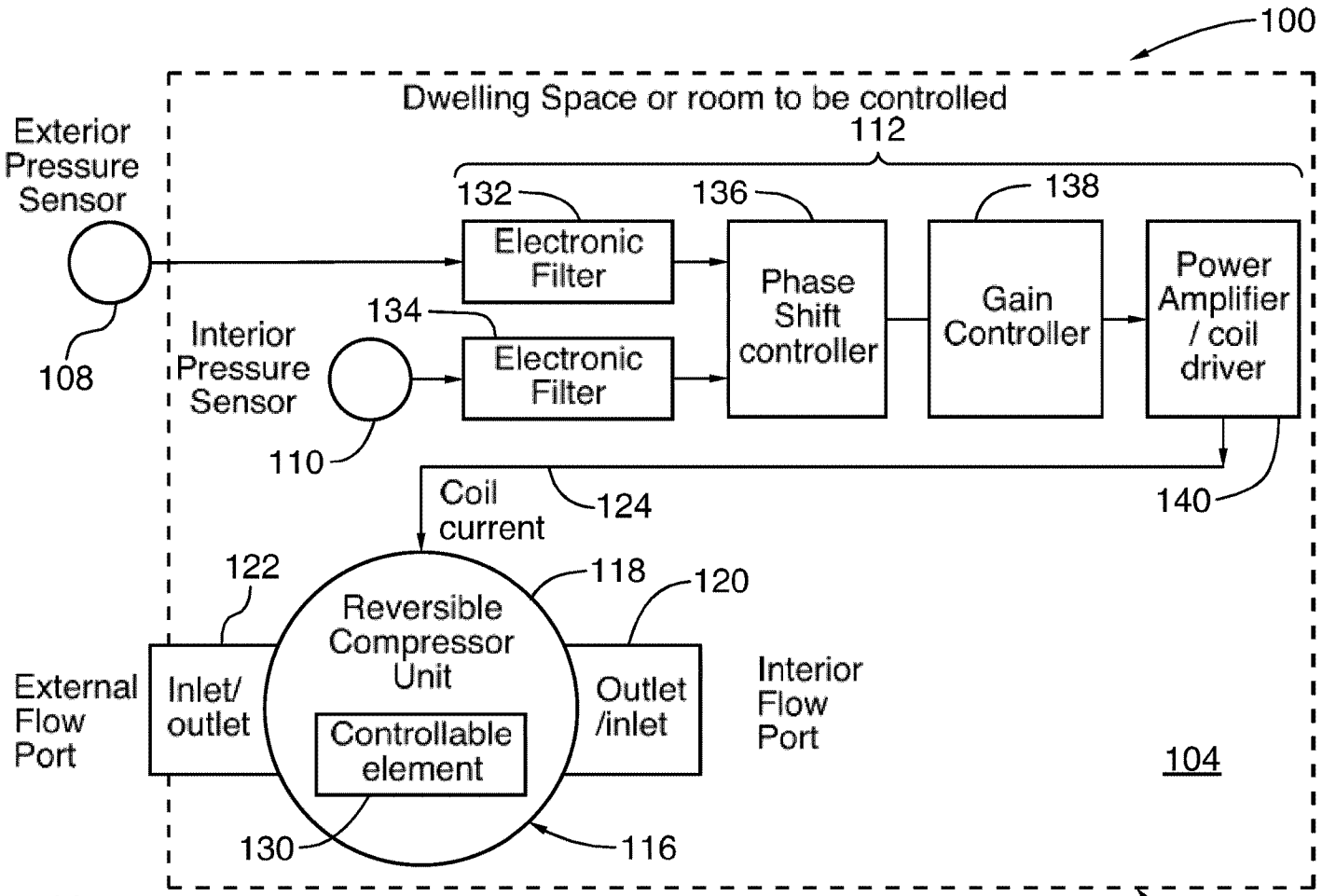
FIG. 2 illustrates a detailed block diagram of the system of FIG. 1.

Reference is first made to FIGS. 1 and 2, which illustrate in block diagram form a system 100 configured to control or cancel infrasonic pressure fluctuations (infrasound) inside a structure 102, in accordance with an example embodiment. In some example embodiments, the structure 102 can be a room, dwelling, building, vehicle, etc., or at least a part thereof. As shown in FIG. 2, the structure 102 defines an interior 104 and has a corresponding exterior 106. In some example embodiments, the exterior 106 may have a source (not shown) of unwanted infrasound, which may be caused from an industrial process or device (not shown) such as a large wind turbine. In other example embodiments, the exterior 106 may be another room or source of unwanted pressure oscillations, such as from an HVAC or utility room, circulating system, propeller, etc., for example.

In accordance with an example embodiment, the system 100 includes an exterior pressure sensor 108, an interior pressure sensor 110, at least one controller 112, and a controllable electro-mechanical unit 114 which includes a reversible compressor 116 or two-way compressor. Generally, the at least one controller 112 is configured to control the compressor 116 to cancel positive and negative pressure oscillations within the interior 104 of the structure 102 based on the pressures detected by the interior pressure sensor 110 and the exterior pressure sensor 108. The pressure within the interior 104 of the structure 102 is controlled at a relatively constant value as a function of time, thereby substantially suppressing undesired pressure disturbances that would be disturbing the interior 104 of the structure 102 from the exterior 106 of the structure 102. At least some of the controller 112 can be part of the compressor, in some example embodiments.

Referring to FIG. 2, the exterior pressure sensor 108 is located to sense pressure indicative of the exterior 106 of the structure 102, and provide an associated signal in proportion to the amount of pressure sensed. This location may be in a volume which is effectively isolated from the control area such as a dwelling attic, or an external or separate building or room, or the outside ambient environment which is also subject to the externally sourced nuisance infrasound. As well, the interior pressure sensor 110 is located to sense pressure indicative of the interior 104 of the structure 102, and provide an associated signal in proportion to the amount of pressure sensed. This is the control environment to be controlled, wherein the pressure is controlled to be relatively constant.

Figure 3:
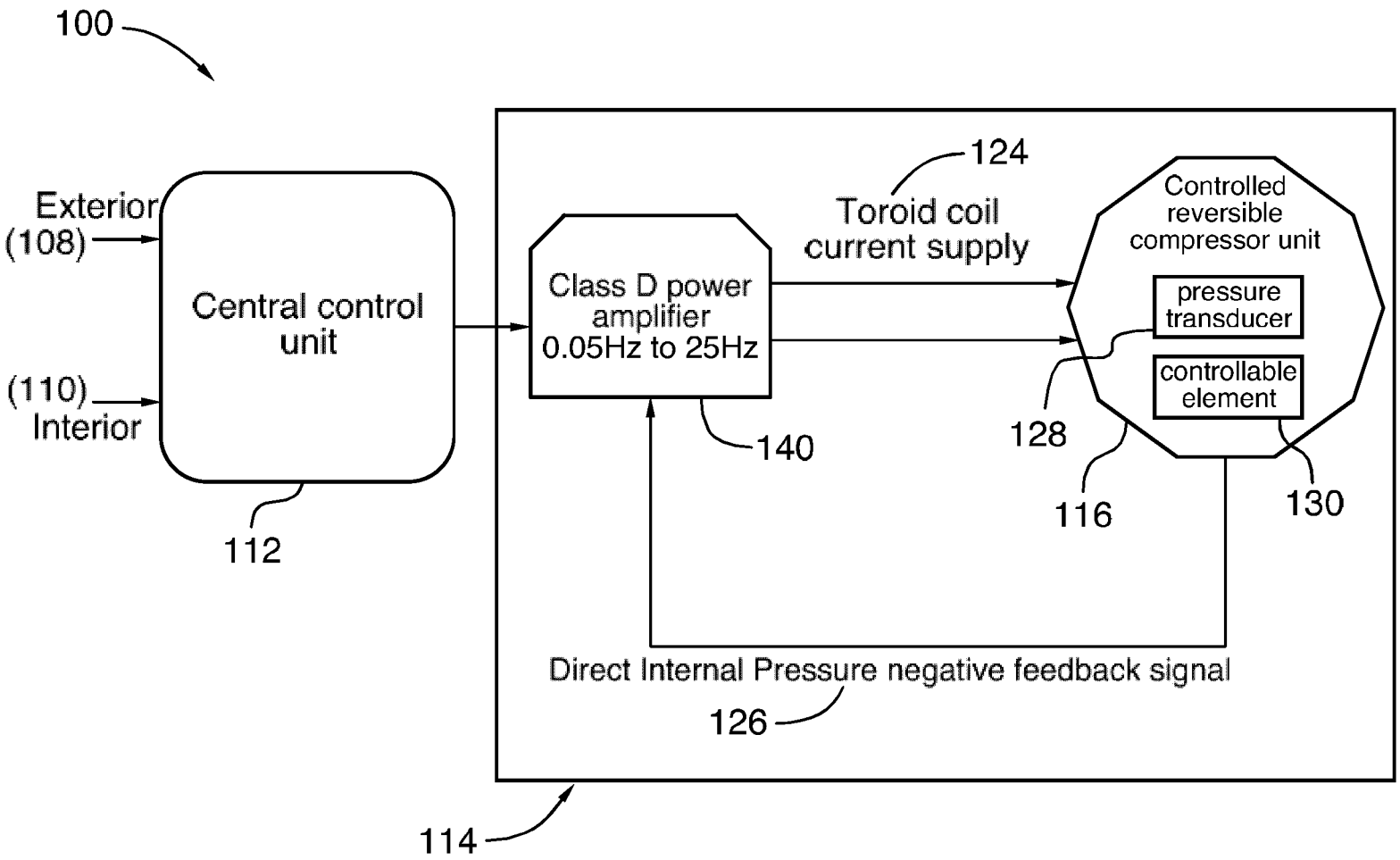
FIG. 3 illustrates another detailed block diagram of the system of FIG. 1, illustrating detail of an electro-mechanical unit.

FIG. 3 illustrates a detailed block diagram of the system 100 of FIG. 1, illustrating detail of the electro-mechanical unit 114. Referring to FIGS. 2 and 3, the compressor 116 includes a housing 118 which defines an interior opening interface 120 open to the interior 104 of the structure 102 and an exterior opening interface 122 open to the exterior 106 of the structure 102. While the compressor 116 is illustrated as being located in the interior 104 of the structure 102, in other example embodiments the compressor 116 is located at the exterior 106 of the structure 102, with the interior opening interface 120 interfacing with the interior 104 from the exterior 106. Within the housing 118, there is at least one controllable element 130 of the compressor 116 such as a magnetic blade or blade (not shown here) that can be controlled by an electromagnet 812 (FIG. 8) driven by a coil current 124 provided from an amplifier 140. In an example embodiment, the compressor 116 also includes its own pressure transducer 128. Referring to FIG. 3, in an example embodiment the at least one controllable element 130 of the compressor 116 is further controlled using a direct internal pressure negative feedback signal 126, using information from the pressure transducer 128, in a negative feedback loop configuration, as shown. This provides that the desired specified amount of current from the controller 112 is being properly performed by the compressor 116. The power amplifier (e.g. class D) is incorporated with a frequency response e.g. down to below 0.05 Hz.

Referring again to FIG. 2, in some example embodiments, the at least one controller 112 can include a number of modules or boxes, and can generally include a first set of one or more electronic filters 132 for signals received from the exterior pressure sensor 108, and a second set of one or more second electronic filters 134 for signals received from the interior pressure sensor 110. The filters 132, 134 can include band-pass filters to filter at least one or numerous harmonics, including a fundamental harmonic, second harmonic, third harmonic, etc. In some example embodiments, the at least one controller 112 can also include at least one phase shift controller 136 to adjust any phase difference between the pressure signals of the exterior pressure sensor 108 and the interior pressure sensor 110. In some example embodiments, the at least one controller 112 can also include at least one gain controller 138 for determining and applying the amount of gain to the signal. In an example embodiment, the resultant signal which is sent to the driver 140 is typically the signal of the external pressure sensor 108, which is processed, inverted, filtered and/or phase shifted, with a gain factor. In an example embodiment, the gain factor is dependent from the pressure signals of the exterior pressure sensor 108 and the interior pressure sensor 110. An inverter (not shown here) can also be used to invert the signal, as appropriate, to cancel the detected interior pressure depending on the particular system setup. The signal (or an inverted signal) from the gain controller 138 is sent to the power amplifier/coil driver 140 to cancel the pressure oscillations within the interior 104. These modules are described in greater detail below.

Figure 4:
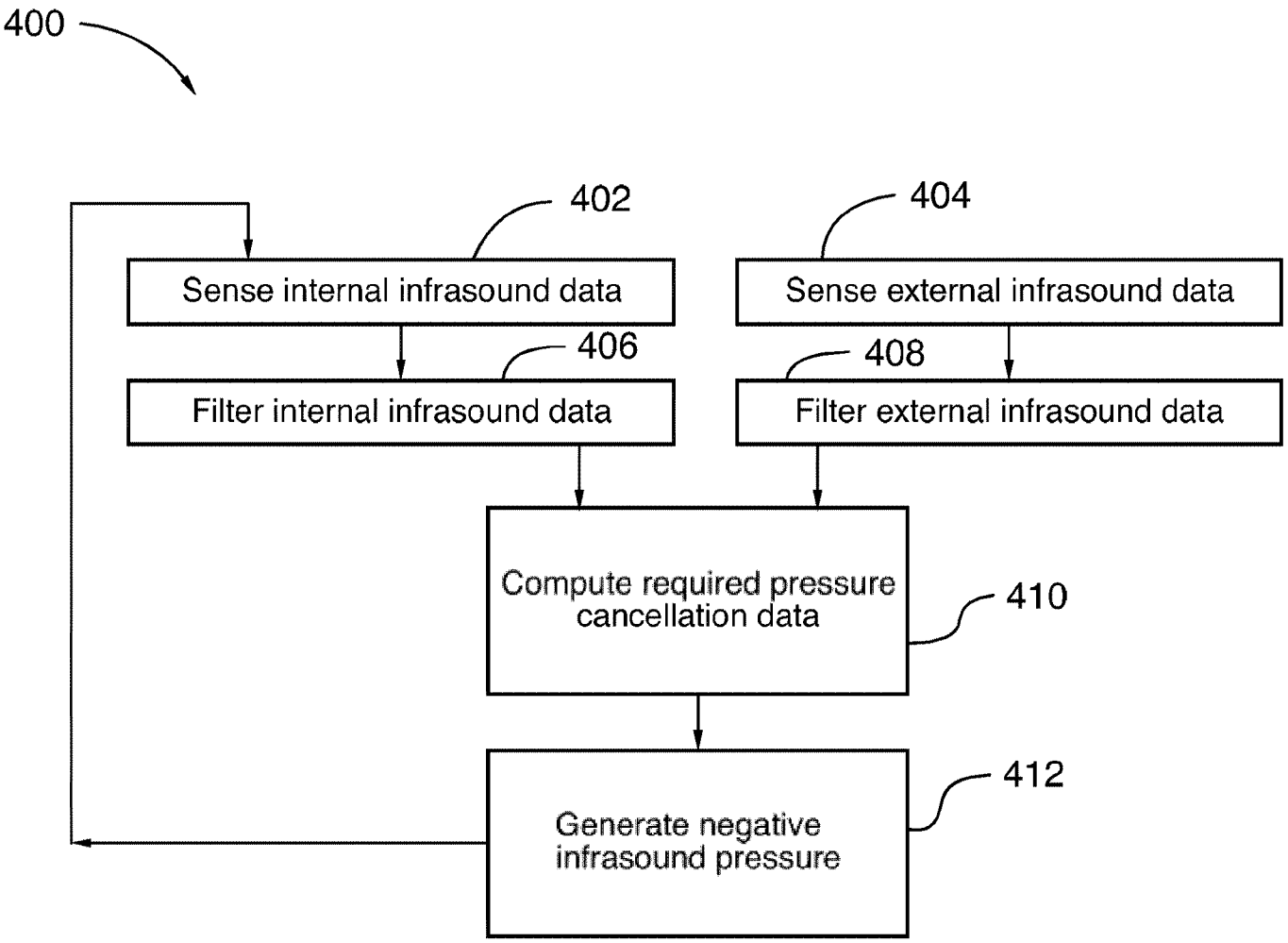
FIG. 4 illustrates a flow diagram of an example method for controlling infrasound, in accordance with an example embodiment.

Reference is now made to FIG. 4, which illustrates a flow diagram of an example method 400 for controlling infrasound of the structure 102 using the system 100 (FIG. 2), in accordance with an example embodiment. At least some of the method 400 may be performed by the at least one controller 112, for example. At event 402, the interior pressure sensor 110 senses the interior pressure, and the at least one controller 112 accordingly determines the pressure sensor information from the interior pressure sensor 110. At event 404, the exterior pressure sensor 108 senses the exterior pressure, and the at least one controller 112 accordingly determines the pressure sensor information from the exterior pressure sensor 108. At event 406, the band pass filter(s) 134 band pass filter specified harmonics from the pressure sensor information indicative of the interior 104 of the structure 102. At event 408, the band pass filters 132 band pass filter specified harmonics from the pressure sensor information indicative of the exterior 106 of the structure 102. Accordingly, this results in at least one order of harmonics that can be individually determined from each of the pressure sensors 108, 110 (FIG. 2).

Still referring to FIG. 4, at event 410, the at least one controller 112 computes the required pressure cancellation data that is required for the compressor 116 to cancel the oscillating disruptions of the interior 104 of the structure 102, based on the determined at least one order of harmonics from each of the pressure sensors 108, 110. This typically requires determining an amount of gain to apply to each of the band pass filtered harmonics of the pressure sensor information indicative of the exterior 106 of the structure 102, phase shifted as appropriate. The amount of gain may be based on the determined first and second pressure sensor information. At event 412, the at least one controller 112 controls the compressor 116 with an amount of drive derived from the exterior pressure sensor signal, band pass filtered and phase shifted to generate the applicable negative infrasound pressure for each of the determined order harmonic, to cancel those pressure harmonics from the control space.

Figure 7:
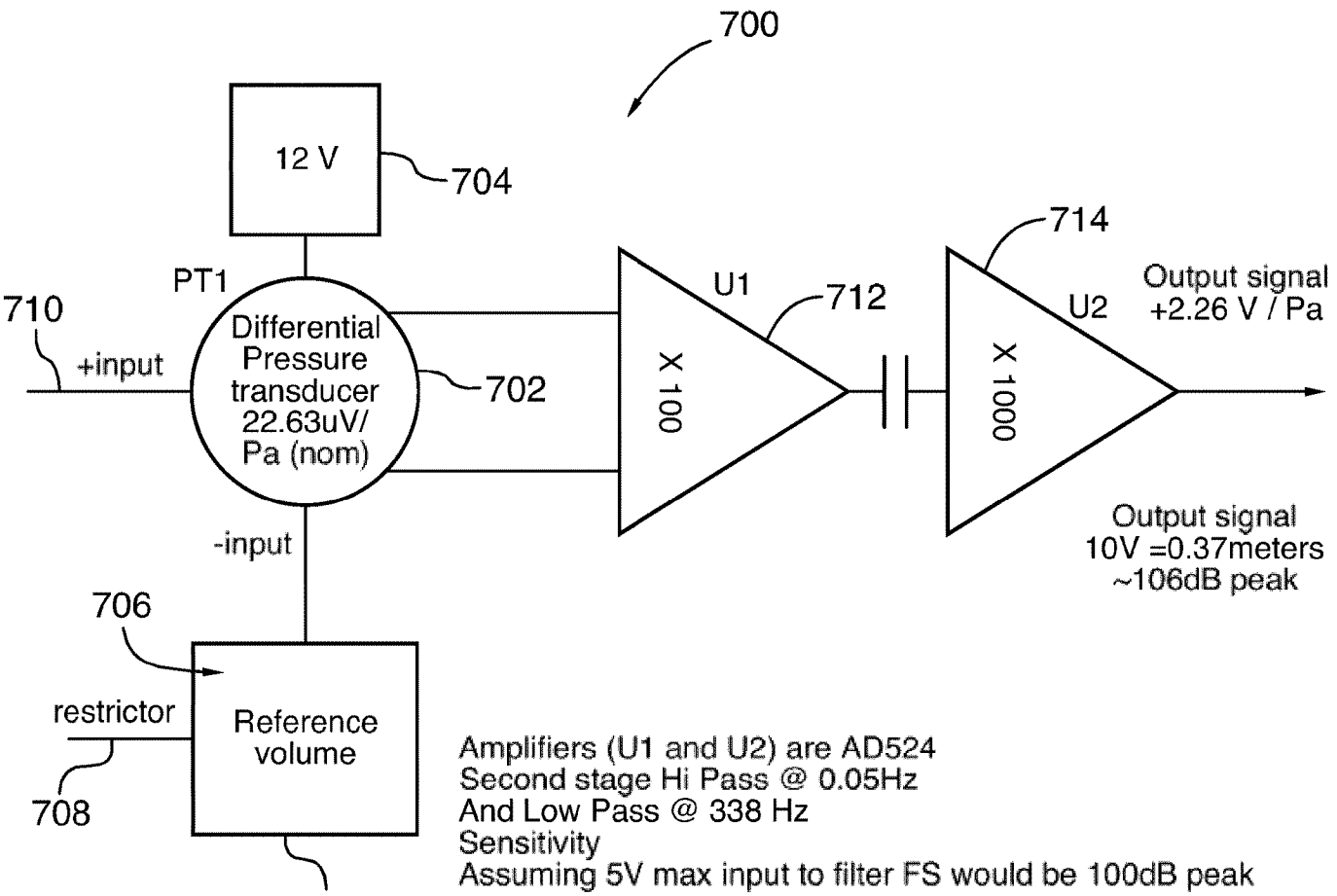
FIG. 7 illustrates a detailed block diagram of a pressure sensor unit, of the system of FIG. 1, in accordance with an example embodiment.

FIG. 7 illustrates a detailed block diagram of a pressure sensor 700, in accordance with an example embodiment, which can be illustrative of one or both of the pressure sensors 108, 110 shown in FIGS. 1 and 2. The pressure sensor 700 includes a differential pressure transducer 702 for detecting pressure changes and providing a signal indicative thereof. The differential pressure transducer 702 is biased by a reference voltage 704 (12 V in this example) and an aluminum casing 716 defining a reference volume 706 having an associated reference pressure. The reference volume 706 is typically the steady state pressure which is only affected by gradual changes in the ambient. A restrictor 708 is used for equalizing the reference volume 706 to the surrounding ambient, steady state or average ambient pressure. The differential pressure transducer 702 receives air input 710 from surrounding air and provides a voltage signal in proportion to the pressure changes or oscillations of the air input 710 with respect to the reference volume 706. This voltage signal therefore is representative of the detected pressure information, being the delta in pressure from the reference volume 706. A first amplifier 712 and second amplifier 714 provide gains to the voltage signal from the differential pressure transducer 702. By way of example only, the output signal from the second amplifier 714 can be +2.26 Volts per Pascal (V/Pa), from the reference volume 706. In some example embodiments, some of the functions of the pressure sensor 700 can be performed by the at least one controller 112. For example, in an alternate embodiment the at least one controller 112 may be used to determine the steady state reference pressure using an average or moving average, etc. This can be determined using raw pressure data detected from the pressure sensor 700, which may not require the reference pressure.

The at least one controller 112 of the system 100 will now be described in greater detail, with reference to FIG. 5 which illustrates a detailed block diagram of an exterior or equivalent pressure sensor signal conditioning system 500 for the pressure sensor information from the exterior pressure sensor 108, and FIG. 6 which illustrates a detailed block diagram of an interior pressure sensor signal conditioning system 600 for the pressure sensor information from the interior pressure sensor 110, in accordance with an example embodiment.

Generally, the at least one controller 112 includes electronic signal filtering of harmonics of the pressure sensors 108, 110, in conjunction with phase shift control, to provide a calculated coil current 124 (FIG. 2) with appropriate current magnitudes and frequencies, to control the air density within the interior 104, thus controlling the pressure within the interior 104 at a relatively constant value as a function of time, thus substantially suppressing undesired pressure oscillations.

The filtering of the pressure information from the pressure sensors 108, 110 can generally be configured with two sets of effectively parallel electronically tunable band-pass filters 132, 134. The number of filters for each set of filters 132, 134 can be equal to a specified number of significant harmonic components in the infrasound signals entering the interior 104 from the source of disruption, from the exterior 106. The trade-off for considering more harmonics is the additional amount of filters and/or processing required. In the examples shown in FIGS. 5 and 6, for example five harmonics are considered, with the first set of band-pass filters 132 having five filters including the fundamental harmonic and the second to fifth order harmonics. The example shown also has the second set of band-pass filters 134 having five filters, for the same order of harmonics.

Figure 5:
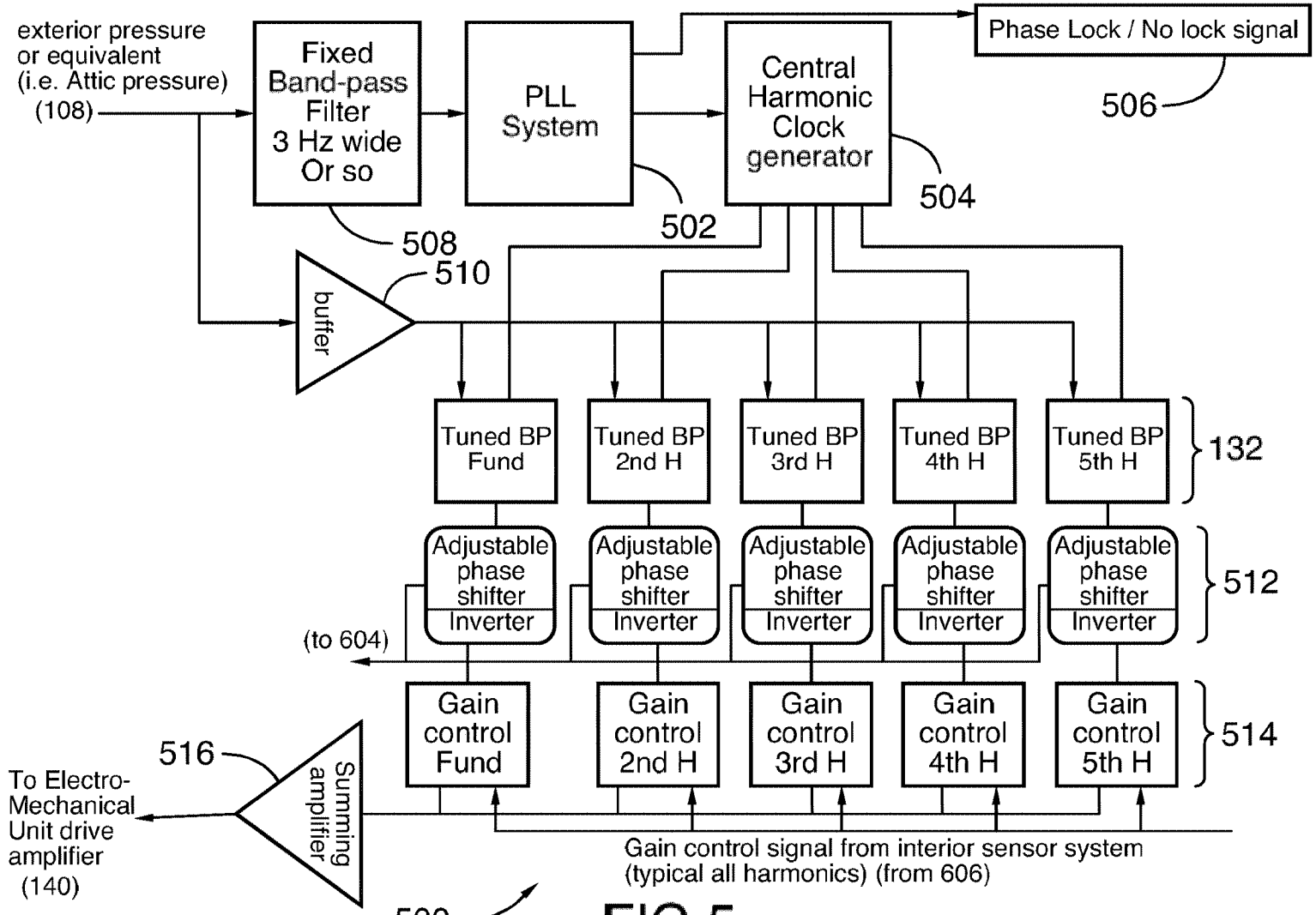
FIG. 5 illustrates a detailed block diagram of an exterior or equivalent pressure sensor signal conditioning system, of the system of FIG. 1, in accordance with an example embodiment.

Referring now to FIG. 5, the pressure sensor information from the exterior pressure sensor 108 is processed by the band-pass filters 132. For example, this provides a reference pressure signal indicative of the exterior 106 (FIG. 2). In some example embodiments, the exterior pressure sensor 108 may be in a volume which is effectively isolated from the control area interior 106 such as a dwelling attic or an external or separate building or room, anywhere indicative of the pressure of the exterior opening interface 122, or simply the outside ambient environment which is also subject to the externally sourced nuisance infrasound.

Figure 6:
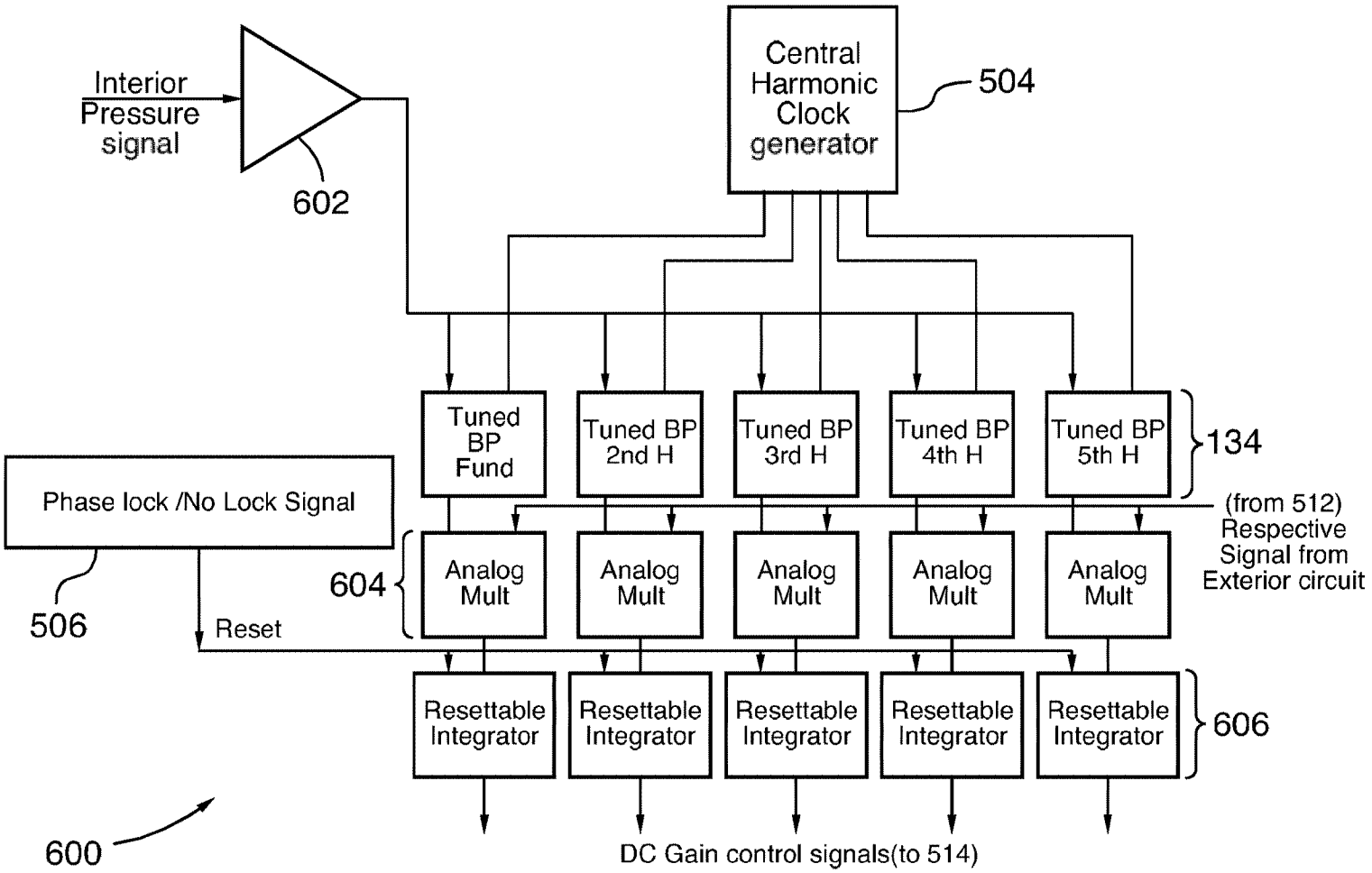
FIG. 6 illustrates a detailed block diagram of an interior pressure sensor signal conditioning system, of the system of FIG. 1, in accordance with an example embodiment.

Referring now to FIG. 6, the second set of band-pass filters 134 is fed pressure sensor information from the interior pressure sensor 110, which can be located within the control area interior 106 where maximum suppression of the infrasound is desired, anywhere indicative of the pressure at the interior opening interface 120, or an area indicative of the interior 106, such as part of or located next to a thermostat or barometer. Both sets of band-pass filters 132, 134 can be essentially identical, and may be set up such that they are configured to pass the fundamental infrasound frequency causing the problem, and each of both the odd and even harmonics related to the fundamental frequency.

Referring again to FIG. 5, a Phase Locked Loop system (PLL) 502 is fed the pressure sensor information from the exterior pressure sensor 108. Once the PLL 502 locks onto at least one or all of the harmonics, a signal can be sent to indicate a phase lock 506. In other example embodiments, instead of signal, a flag, alerts, indicator, etc., can be used. Signal information from the PLL 502 is used by a central harmonic clock generator 504 to generate a series of harmonically related clock signals, which control the band-pass frequencies of both sets of filters 132, 134, by locking onto at least one of the harmonics of the nuisance source frequency arriving at the structure 102. In some example embodiments, an additional fixed frequency band-pass filter 508 may be used as a part of the PLL 502, to limit the frequency band that may be applied to the system input to the PLL 502. In some example embodiments, a search feature is incorporated into the PLL 502, which causes a Voltage Controlled Oscillator (VCO) of the PLL 502 to sweep over a wider range than the nominal capture range of the PLL 502, to ensure that the PLL 502 locks into an appropriate nuisance signal, the frequency of which may be variable at various times (e.g. wind turbines and other machine often vary in operating frequency).

Referring again to block 506, a "Locked In" signal is generated by the PLL 502, which inhibits the search function controlling the VCO and acts as a reset when no signal is locked, e.g. controls the state of integrators 606 circuitry of the system 600 (FIG. 6). A loss of lock signal (e.g. not locked in) is significantly delayed following the loss of a nuisance signal, such that normal interruptions of the nuisance infrasound/noise signal do not immediately result in any changes to the integrator function (the complete function will become clear as the full description is understood). Loss of lock, or a loss of lock that exceeds a pre-determined period of time, results in the "locked in" signal being reset, which results in a reset signal being sent to the integrators 606, and the search function related to the VCO sweep circuit is re-initialized to re-search out a nuisance signal.

The exterior (reference) pressure sensor information signals can pass through a buffer 510 which are then band-pass filtered by the band-pass filters 132, and are therefore separated into the individual Fourier components by the band-pass filters 132. The filtered signals for each order of harmonic are fed into individual phase shift controllers 512 and/or inverters (as appropriate). Individual gain controllers 514 for each harmonic are used to apply a gain element to each harmonic of the received signals, which are provided to a summing amplifier 516, where the signal conditioned Fourier components are re-combined into a composite signal. The composite signal is fed to the power amplifier/coil driver 140 to cancel the pressure oscillations within the interior 104, representative of the one or more harmonic frequencies. The phase shift controllers 512 compensate each Fourier component to shift the phase(s) (remove phase differences) of the exterior pressure sensor 108 to match the pressure signal of the interior pressure sensor 110, as some amount of phase lag between the exterior signal and the interior signal is expected.

Referring to FIG. 6, the interior pressure sensor information signals can pass through a buffer 602 which are then band-pass filtered by the band-pass filters 134, and are therefore separated into the individual Fourier components by the band-pass filters 134. The band-pass filters 134 can be clocked or controlled by the same harmonic clock generator 504 as the exterior system 500. The individual order of harmonic signals are then sent to a respective multiplier 604, which can be an analog multiplier, which are multiplied by the same respective order harmonic signals of the phase-shifted exterior pressure signal information from the phase shift controllers 512 (FIG. 5). The multipliers 604 generate the product of the phase corrected external (reference) signal and the inside (controlled area) signal, for each order of harmonic.

The multiplied signals for each respective Fourier component (order of harmonic) are sent to respective integrators 606. The output from the integrators 606 are used to control the gain-controllers 514 (FIG. 5). This configuration results in a DC voltage from the analog multipliers output (i.e. similar to synchronous detection or synchronous rectification), which has a magnitude proportional to the product of the exterior reference (outside) amplitude of a given Fourier component times the interior (inside) corresponding Fourier component. The integrators 606 integrates this value over time causing the gain-controllers 514 to adjust the magnitude of that Fourier component in the composite signal from the summing amplifier 516, until the multiplier product approaches zero. The interior sensed pressure signal from the interior pressure sensor 110 is thus minimized to an effectively zero amplitude over a period of time determined by the integrator time function. If the exterior pressure signal from the exterior pressure sensor 108 (e.g. the source of the interior pressure disruption) should diminish, the interior signal will also diminish, maintaining the state of the integrators 606 at the same condition (i.e. no change in gain due to changes in nuisance source amplitude). This will maintain the state of the integrators 606 at the ready if the source amplitude recovers within a specified time delay period. For example, there may be periodic variation in source amplitude as a result of multiple sources of very similar amplitudes and frequency of infrasound arriving at the single location, from several wind turbines e.g. a beat frequency phenomenon.

The combined functioning of the integrator 606, gain controller 514 in conjunction with the analog multipliers 604 and interior/exterior sensors 108, 110 is to effectively determine a transfer function between the exterior infrasound source and the interior infrasound reception, such that the inverse of the exterior signal as it appears in the interior can be applied to the interior of the structure 102 to substantially cancel out the related interior infrasound magnitude.

Figure 8:
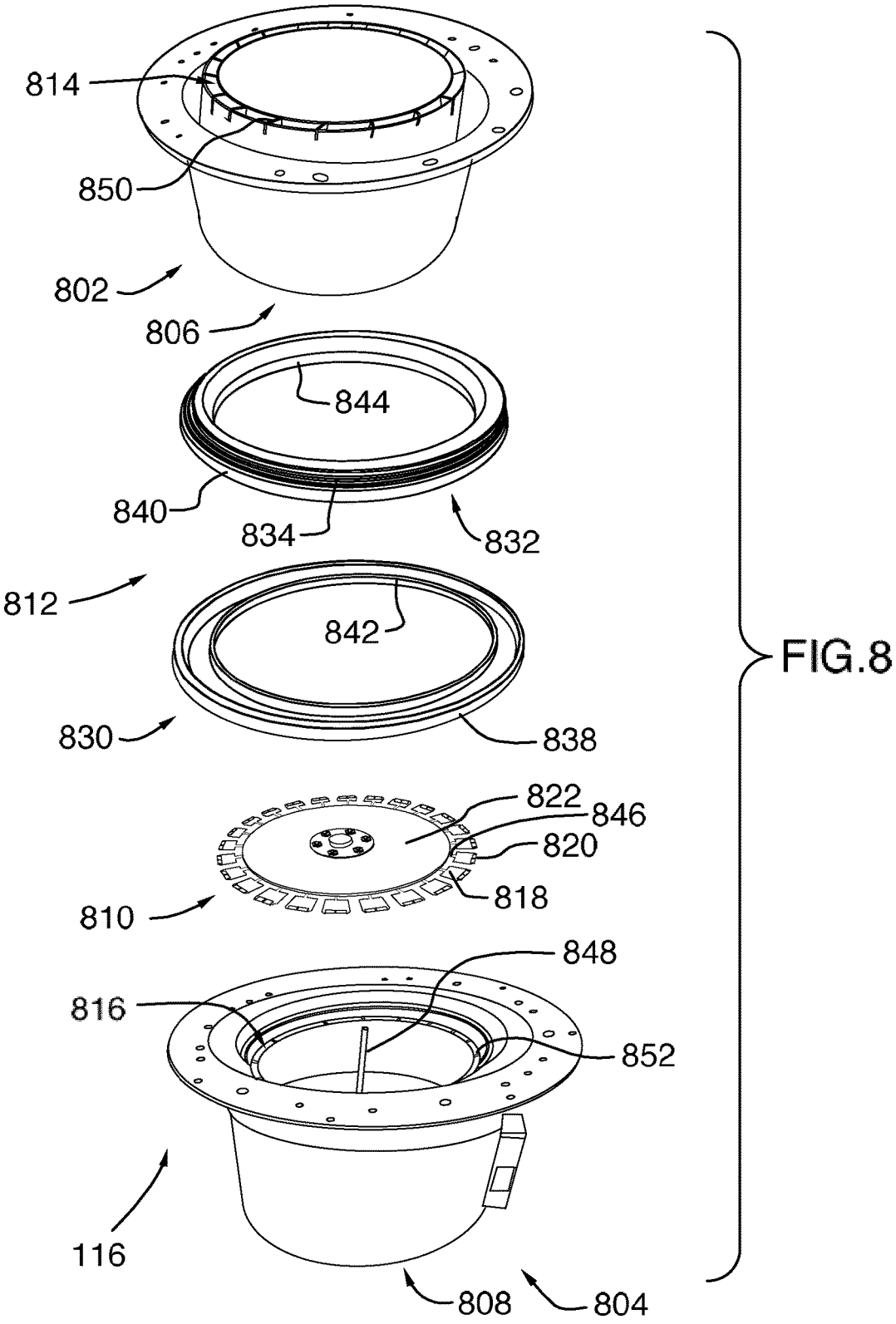
FIG. 8 illustrates an exploded view of an infrasound generating compressor to be used in the system of FIG. 1, in accordance with an example embodiment.

Reference is now made to FIGS. 8 to 15, which illustrate an example embodiment of the reversible compressor 116, and illustrates in detail the electro-mechanical components thereof. Reference is first made to FIG. 8, which illustrates an exploded view of the compressor 116, which can for example be an axial compressor. The compressor 116 can, for example, be installed or retrofit in between the exterior 106 and the interior 104 of the structure 102 (FIG. 2), to create pressure flows between the exterior 106 and the interior 104 and controlled in the manner as described herein. For example, the compressor 116 can be installed or retrofit similar to that of a window air conditioning unit (not shown).

In the example embodiment shown in FIG. 8, the compressor 116 includes an exterior housing 802 and an interior housing 804 which collectively form the main housing 118 of the compressor 116, and which can be connected together. A rotor 810 is positioned between the exterior housing 802 and the interior housing 804, which can be held in place by a central drive shaft 848, which also defines a rotational axis of the rotor 810. The drive shaft 848 is typically driven at a relatively high RPM, for example to hundreds or thousands of RPM, and can be controlled by the at least one controller 112 or by a separate power source or drive, for example. The drive shaft 848 can be drive at a constant speed, in an example embodiment. An electromagnet 812 in the form of a toroid assembly with coil circumferentially surrounds the rotor 810, while the interior housing 804 circumferentially surrounds the electromagnet 812.

Figure 9:
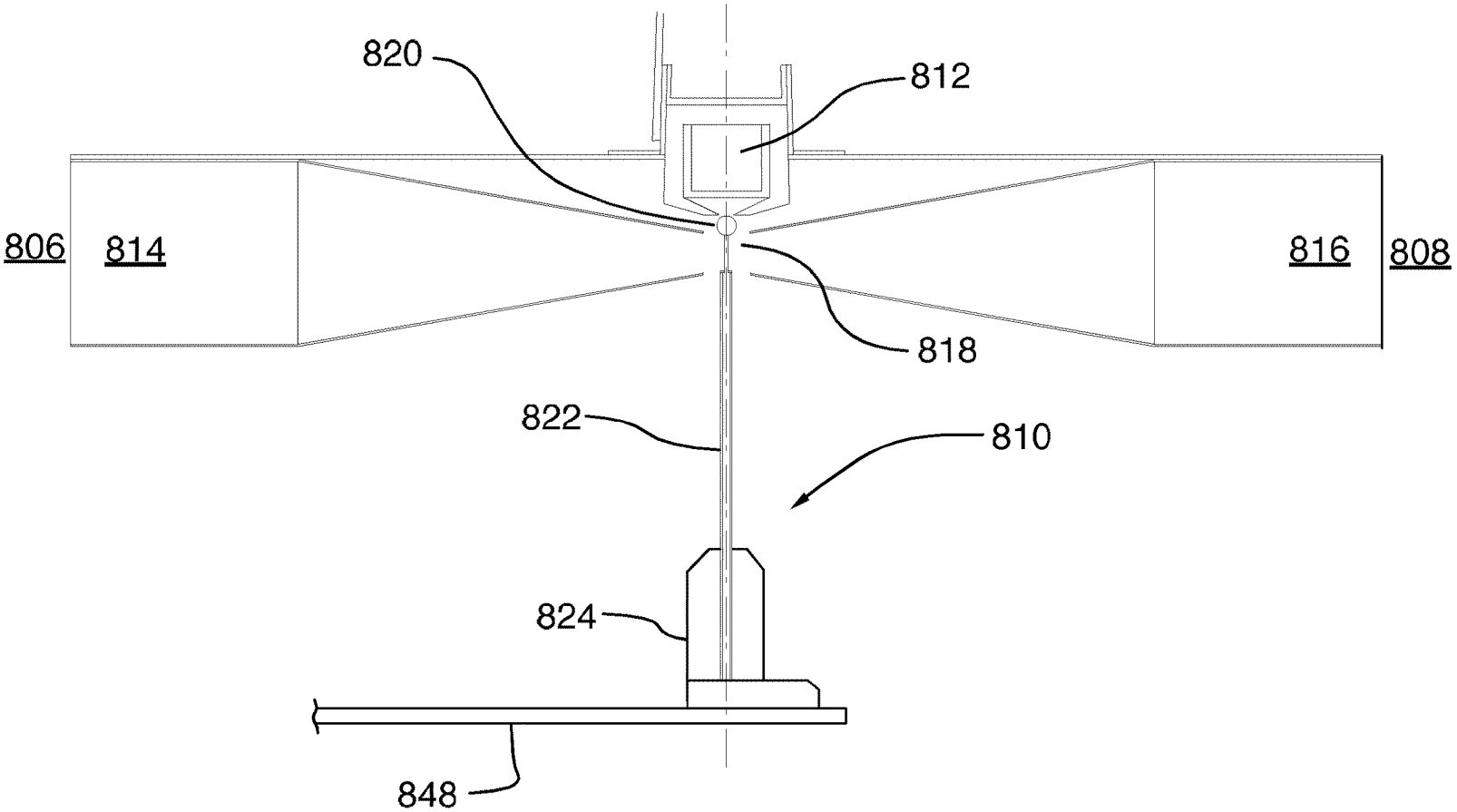
FIG. 9 illustrates in diagrammatic form a partial top-half cross-section of the assembled infrasound generating compressor of FIG. 8, the remaining partial bottom-half cross-section being substantially a mirror image thereof (not shown here)

In some example embodiments, the exterior housing 802 defines an opening interface 806 which is open to the exterior 106 through a respective flow passage(s) 814, while the interior housing 804 defines an opening interface 808 which is open to the interior 104 through a respective flow passage(s) 816. As shown in FIG. 9, the flow passages 814, 816 can be tapered towards the rotor 810.

As shown in FIG. 8, the rotor 810 includes a compressor disc 822 and a plurality of blades 818 which radially extend from respective blade stems 846 which are mounted to the compressor disc 822. In an example embodiment, the compressor disc 822 is driven by a driver motor 824 (FIG. 9), for example, at a relatively constant speed. In another example embodiment, not shown, the speed of the drive motor 824 is yet another variable to be controlled, at variable speed, as part of the overall variable control loop by the one or more controllers 112.

In an example embodiment, the blades 818 are generally positioned between the two flow passages 814, 816, to generate airflows in a controlled manner there through, for example to create input or output flows between the exterior 106 and the interior 104. In an example embodiment, the blades 818 are magnetic, for example each blade 818 can have a respective magnet 820 at the respective end. In other example embodiments, not shown, the blades 818 themselves are at least partly formed of magnetic material.

In an example embodiment, in a normal or resting state, each blade 818 can be blade shaped or flat and be oriented perpendicular to that of the flow passages 814, 816, which can be considered zero degrees as a reference angle. In other words, the blades 818 are parallel to the direction of rotation of the rotor 810. In this state, no air flow (other than incidental) should occur as a result of rotating of the compressor disc 822. In an example embodiment, the plurality of blades 818 are formed of resilient material to act as a torsion spring, to twist in a range of positive and negative blade angles to generate respective positive and negative airflows between the exterior opening interface 806 and the interior opening interface 808, in combination with the relatively constant rotation of the compression disc 822. In other example embodiments, the blades 818 can be curved, double s-shaped, or other suitable blade shapes. This amount of twisting of the blades 818 is variable controlled by the electromagnet 812, which results in generation of pressure oscillations, described in detail next.

Referring still to FIG. 8, the electromagnet 812 is shown as first toroid half 830 and second toroid half 832 which circumferentially surrounds the rotor 810. The second toroid half 832 can include a coil winding 834. Each of the halves 830, 832 can be formed of solid mild steel, for example with powdered iron pole pieces. The toroid halves 830, 832 contact each other on the respective outside diameter 838, 840, but the pole pieces do not contact each other on the inside diameters 842, 844. A magnetic field is generated by the coil winding 834 across the gap (in an axial direction) defined by the inside diameters 842, 844 in a typically semi circular magnetic flux pattern. A driver 140 (FIG. 2) is configured to provide positive or negative current to the coil winding 834. For example, referring to FIG. 2, the power amplifier/coil driver 140 provides the coil current 124 in a controlled manner at one or more frequencies. The inside diameters 842, 844 of the toroid halves 830, 832 therefore define opposite magnetic poles as a result of the coil current 124.

Figure 10:
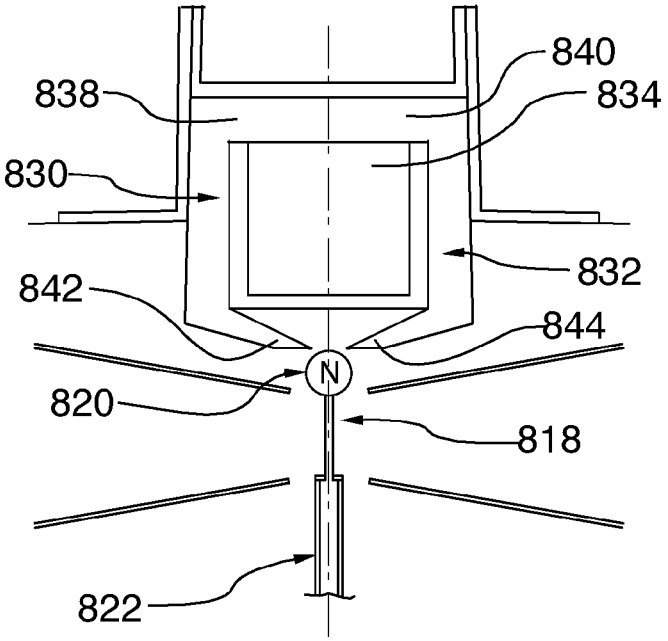
FIG. 10 illustrates in diagrammatic form a detailed view of FIG. 9.
Figure 11:
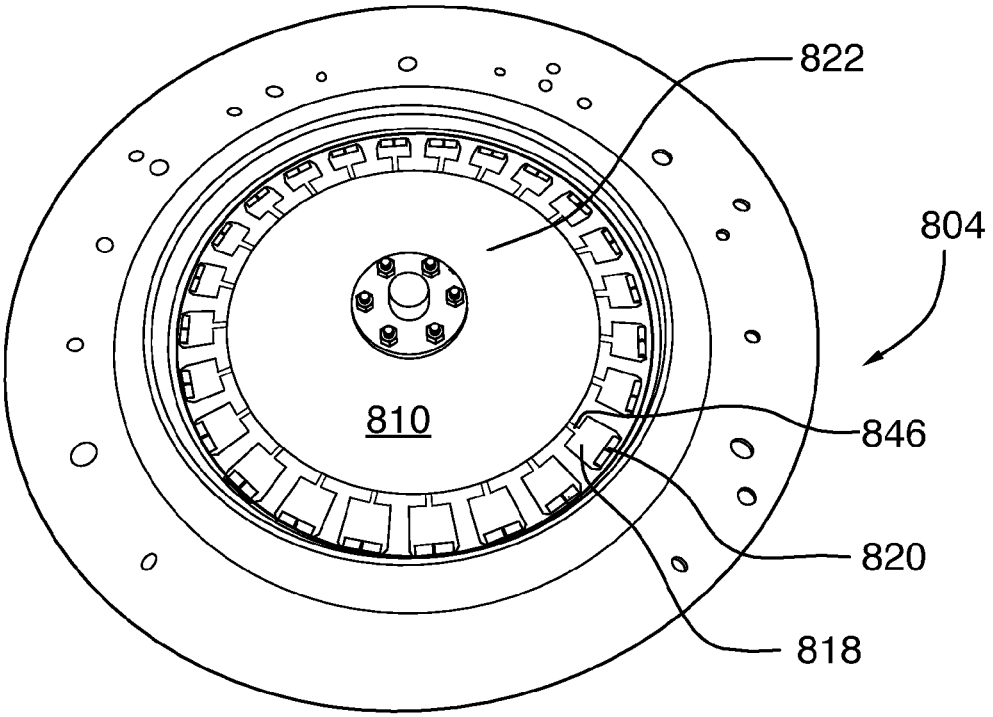
FIG. 11 illustrates an axial view of the assembled infrasound generating compressor of FIG. 8.

Reference is now made to FIGS. 9 and 10, which illustrates in detail how the electromagnet 812 influences the blades 818. The magnets 820 of the blades 818 run very close to the continuous poles all the way round the inside diameter 842, 844 of the toroid as the rotor 810 rotates. The magnets 820 are positioned to be magnetically influenced by both poles and depending on which pole is north and which pole is south, causes the blade 818 to twist or torque in one direction or the other, and the torque is dependent on the amount of coil current 124 applied by the power amplifier/coil driver 140. Accordingly, the blade angle of the blade 818 is controlled by the coil current, and provides a corresponding positive or negative airflow through the flow passages 814, 816 (FIG. 8). In an example embodiment, all blade mounted magnets 820 are oriented in the same north south direction during assembly, so that a same direction of flow is provided by each blade 818 and respective blade angle. Note that the electromagnet 812 does not deliver any rotational torque to the rotor 810, rather, that drive can come from a separate drive motor 824 (FIG. 9) via the central drive shaft 848, typically at a constant high speed. As well, the positive and negative flows are readily performed by controlling the coil current 124, which does not require having to reverse the spinning momentum of the direction of the drive shaft 848, for example.

In another example embodiment, not shown, the rotational torque to the rotor 810 may be provided by a further suitable configured electromagnet arrangement, for example by way of a further stator assembly, rather than the separate drive motor 824 (FIG. 9).

Figure 12:
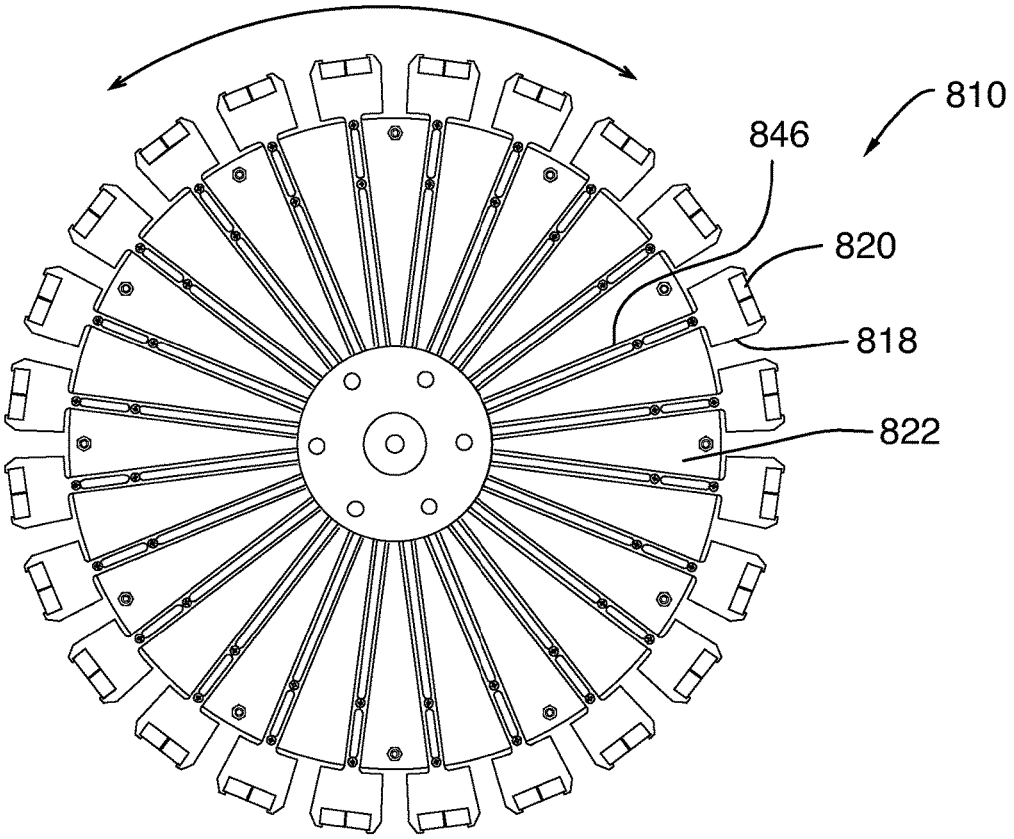
FIG. 12 illustrates an axial view of a compressor rotor for the infrasound generating compressor of FIG. 8, in accordance with an example embodiment.

As best shown in FIG. 12, the compressor disc 822 can be formed of a disc of thin material, and cut, formed or mounted with components in such a way as to form the blades 818. In some example embodiments, the rotor 810 can also be manufactured from non-metallic materials such as plastic, as a single injection molded component with magnets either incorporated during the molding process or added separately later. In some other example embodiments, carbon fiber may also be used as some or all of the material for the blades 818, for resiliency and long term durability.

Referring again to FIG. 10, when the control current 124 in the coil 834 is at zero amps, the magnetic attraction of both poles of the spinning permanent magnets 820 mounted on the blades 818 are equal to each of the poles of the inside diameters 842, 844, thus zero torque is applied to each of the blades 818, and all of the blades 818 remain in a neutral position or zero degrees.

As the DC current in the coil 834 is increased, the poles defined by the inside diameters 842, 844 become more and more magnetized in a given polarity, North or South. This action causes the end poles of the permanent magnets 820 to become attracted to the opposite magnetic pole defined by the inside diameters 842, 844, resulting in a twisting torque being applied to each of the rotating blades 818 of the compressor disc 822 causing the blades 818 to twist a certain amount based on the torsion spring balance against the magnetic torque moment.

The degree of twist of each blade 818 is proportional to the magnitude of current in the coil 834. The torsional stiffness of the blade stem 846 (FIG. 12), which can be mounted to the compressor disc 822 (best shown in FIG. 12), provides a torsional spring force against which the magnetic torque reacts, providing a balancing force at a given blade angle as a function of magnetic torque. With a given polarity of current to the coil 834, the blade angle is such that airflow is forced in one direction through the air flow passages 814, 816. All magnets 820 are positioned with the same polarity arrangement on all blades 818, to obtain the same direction of twist in each case. Applying the opposite direction of current flow in the coil 834 reverses the direction of blade twist and as such airflow direction through the air flow passages 814, 816.

By cyclically varying the current in the coil 834, the blade angle of each blade 818 can be cyclically varied at a determined frequency or frequencies which account for higher order harmonics, resulting in the flow and pressures developed by the compressor 116 cyclically varying in proportion to the coil current 124 magnitude and polarity.

The blade 818 control from the coil current 124 results in the barometric pressure in the structure 102 to vary proportionally as the density of air within the dwelling, to vary as a function of time according to the direction and rate of airflow through the compressor 116, which can be used to cancel unwanted pressure oscillations. The amount of control is dependent on the coil current 124 signals provided by the at least one controller 112, with pressure signal information received from the exterior pressure sensor 108 and the interior pressure sensor 110. The pressure signal information are used to control the coil current 124 applied to the coil 834, in such a way as to cancel the pressure within the desired interior 104 as a function of the cyclic barometric pressure frequencies and/or harmonics of interest.

Figure 14:
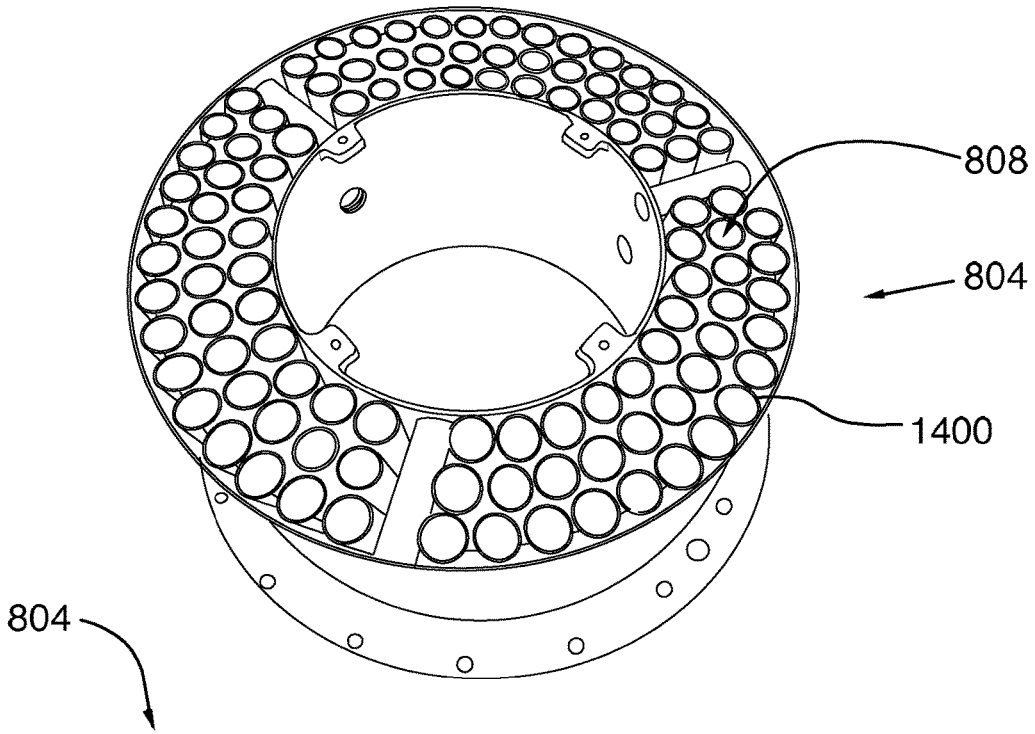
FIG. 14 illustrates an end view of an example housing of the infrasound generating compressor shown in FIG. 8, illustrating spinning mode attenuators, in accordance with an example embodiment.

A noise attenuation feature in accordance with an example embodiment will now be described, with reference now to FIG. 14. FIG. 14 shows in detail an example of the interior opening interface 808 side of the interior housing 804. A similar arrangement can be included in the exterior housing 802, but is typically not required as the noise can typically dissipate into the ambient of the exterior 106.

A plurality of tubes 1400 can be provided on the interior opening interface 808 side. Each tube 1400 can be e.g. on or about 0.017 meters in diameter, and on or about 0.075 meters depth. The shape of the tubes 1400 attenuate spinning modes up to about 10 kilohertz, but will allow plane waves and air flow to pass through. This is used to block the propagation of spinning modes from the rotor 810 into the interior space, for example. This is used to minimize potential blade passing noise from the compressor 116, which would propagate out from the interior opening interface 808 into the interior 104 of the structure 102. In practice, the fundamental blade passing frequency has been found to only be about 650 Hz, but additional harmonics can be generated by the stator vane interaction. This feature can allow the compressor 116 to be driven via the drive motor 824 (FIG. 9), at higher speeds without an increase in the interaction noise. In other example embodiments, not shown, other configurations and shapes can be used, such as hexagonal tubes, and/or such as in a honeycomb configuration, for example.

Figure 15:
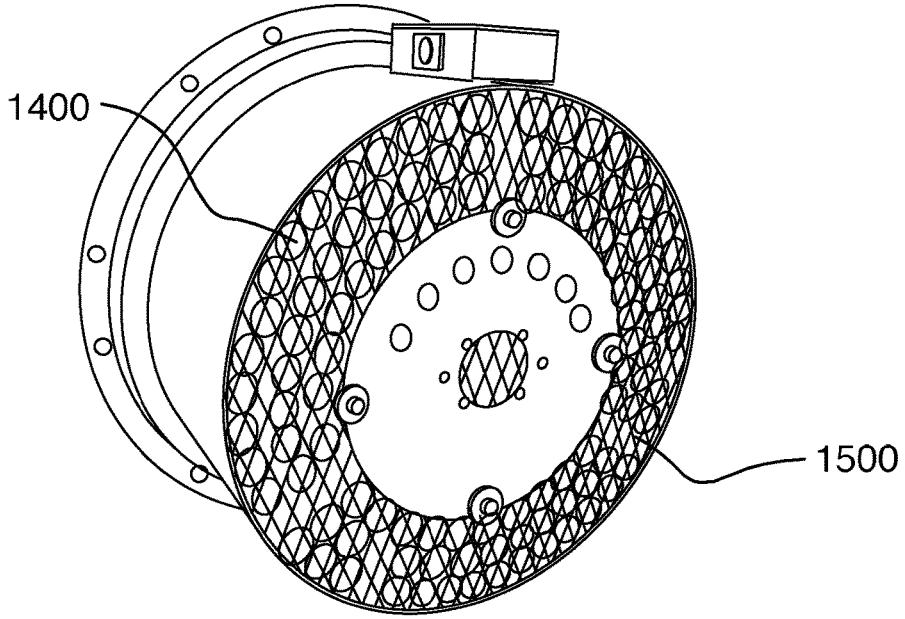
FIG. 15 illustrates an end view of the example housing of FIG. 14, installed with a screen.

Referring now to FIG. 15, the interior housing 804 and the tubes 1400 can be covered by a screen 1500, which permits airflow but filters and prevents foreign objects from entering the interior opening interface 808. A similar type of screen (not shown) can be mounted to the exterior housing 802.

Referring again to FIG. 8, in an example embodiment, a plurality of housing mounted stator vanes 850 of the exterior housing 802 can further define the air flow passage 814. Similarly, a plurality of housing mounted stator vanes 852 of the interior housing 804 can further define the air flow passage 816. In an example embodiment, the stator vanes 850, 852 are about one inch in depth. In an example embodiment, the stator vanes 850, 852 are stationary or static. These stator vanes 850, 852 can assist in redirection or collimation of the airflows in both axial directions through the air flow passages 814, 816.

As described in greater detail below, these stator vanes 850, 852 can be at a biased angle, for example. These stator vanes 850 can be collectively at an opposite angle to the collective angle of the other stator vanes 852, in some example embodiments. These stator vanes 850, 852 can be curved, in some example embodiments.

Figure 29:
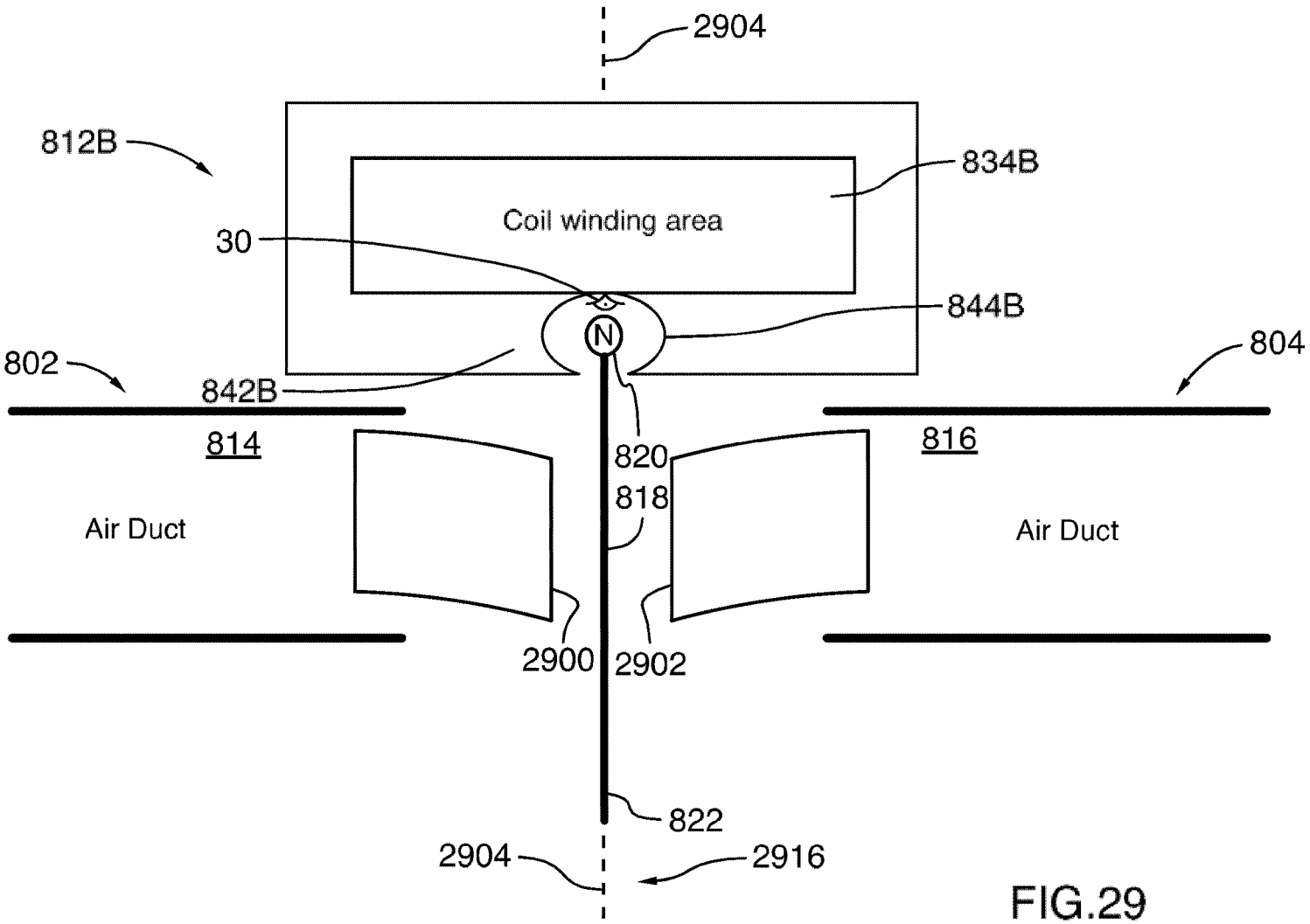
FIG. 29 illustrates, in diagrammatic form, a partial top-half cross-section of a two-way flow control device, the remaining partial bottom-half cross-section being substantially a mirror image thereof (not shown here), in accordance with an example embodiment.
Figure 30:
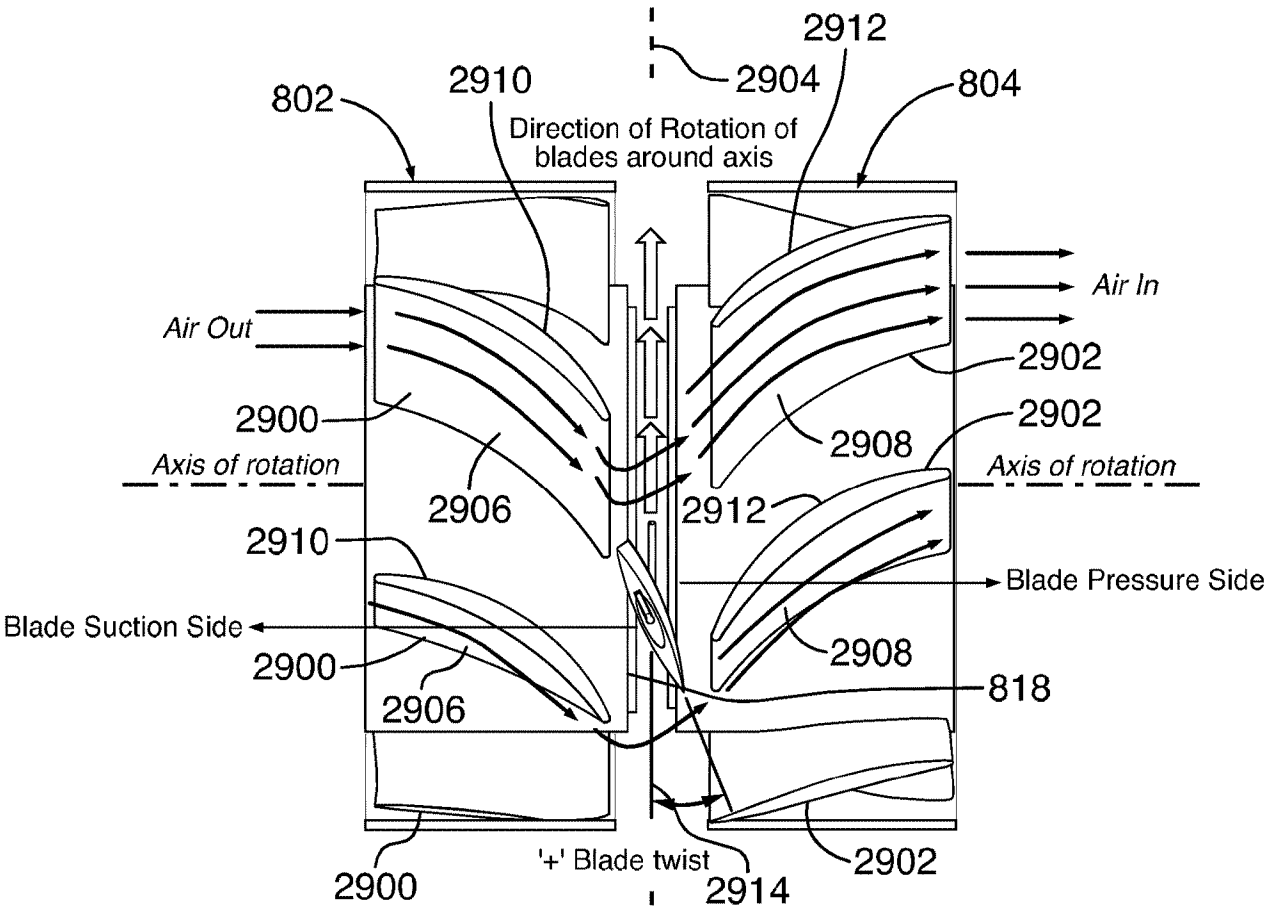
FIG. 30 illustrates in diagrammatic form a radially inward section view of the two-way flow control device of FIG. 29, illustrating airflow guided in one direction by stator vanes.
Figure 31:
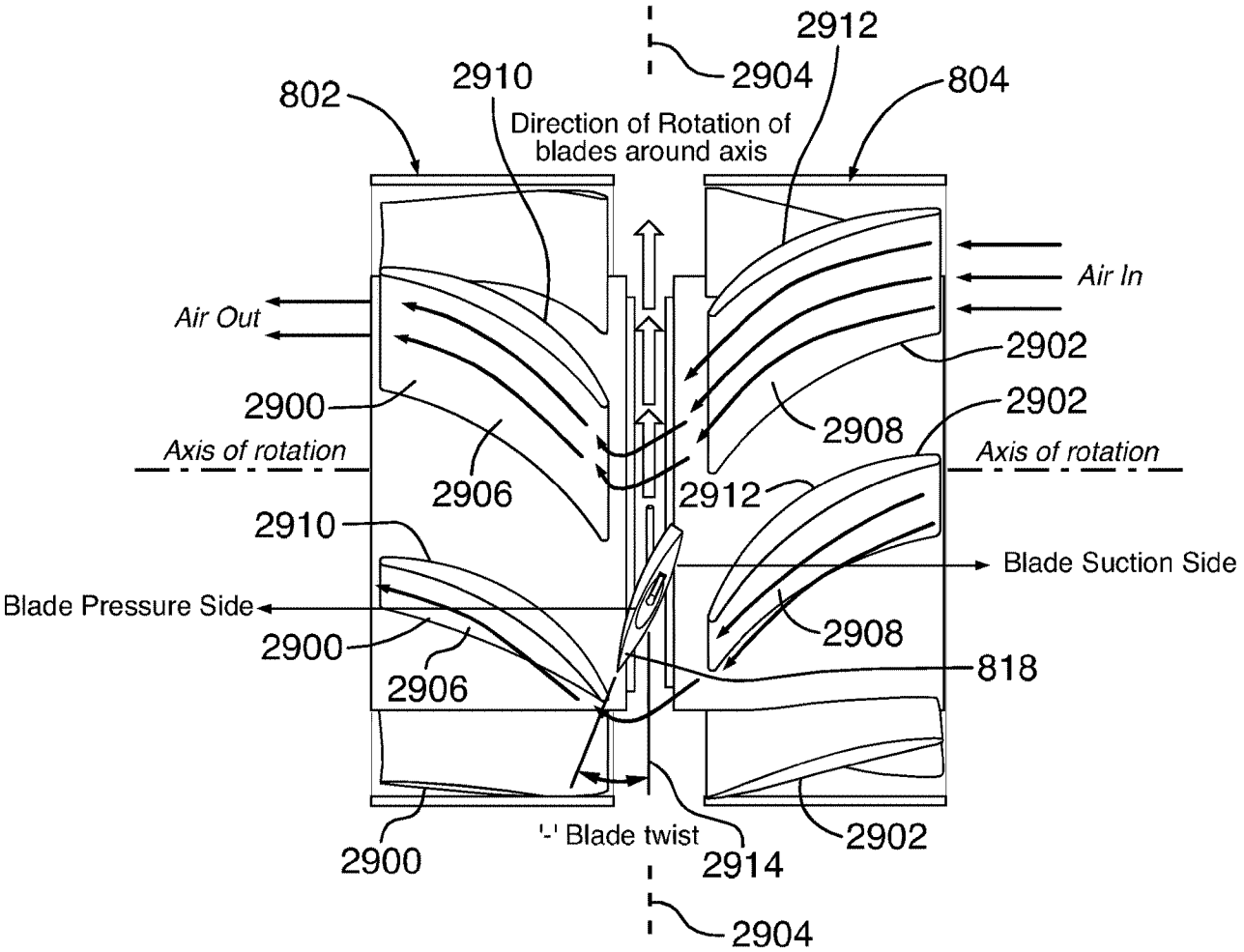
FIG. 31 illustrates the same view as FIG. 30, illustrating airflow guided in an opposite direction by the stator vanes.

Reference is now made to FIGS. 29 to 33 and 36 to 37, which illustrate an example embodiment of a two-way flow control device such as the reversible compressor 116 which includes stator vanes 2900, 2902. Similar reference numbers are used where appropriate for convenience of reference. For example, the device can be used in the system shown in FIGS. 1 and 2. As well, some of the components have been described with respect to the system shown in FIG. 8. FIG. 29 illustrates, in diagrammatic form, a partial top-half cross-section of the two-way flow control device with the stator vanes 2900, 2902. FIGS. 30 and 31 illustrate in diagrammatic form a radially inward section view of the two-way flow control device, viewed from reference viewing eye 30 shown in FIG. 29.

Figure 13:
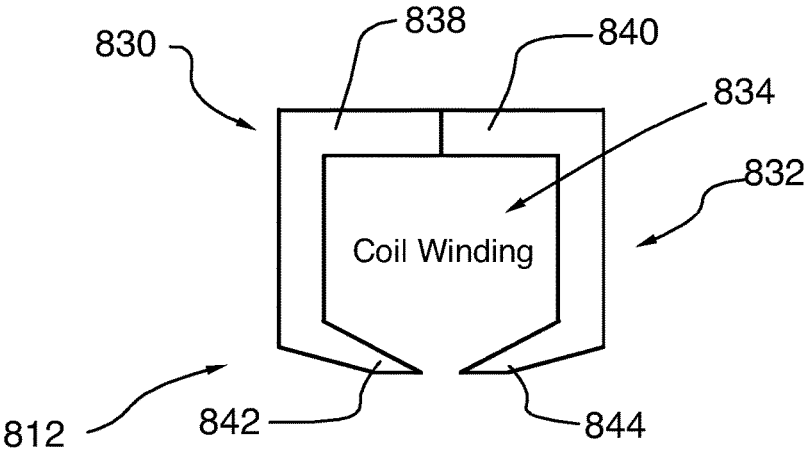
FIG. 13 illustrates in diagrammatic form a partial detail cross-section of an example toroid electromagnetic structure, in accordance with an example embodiment.
Figure 36:
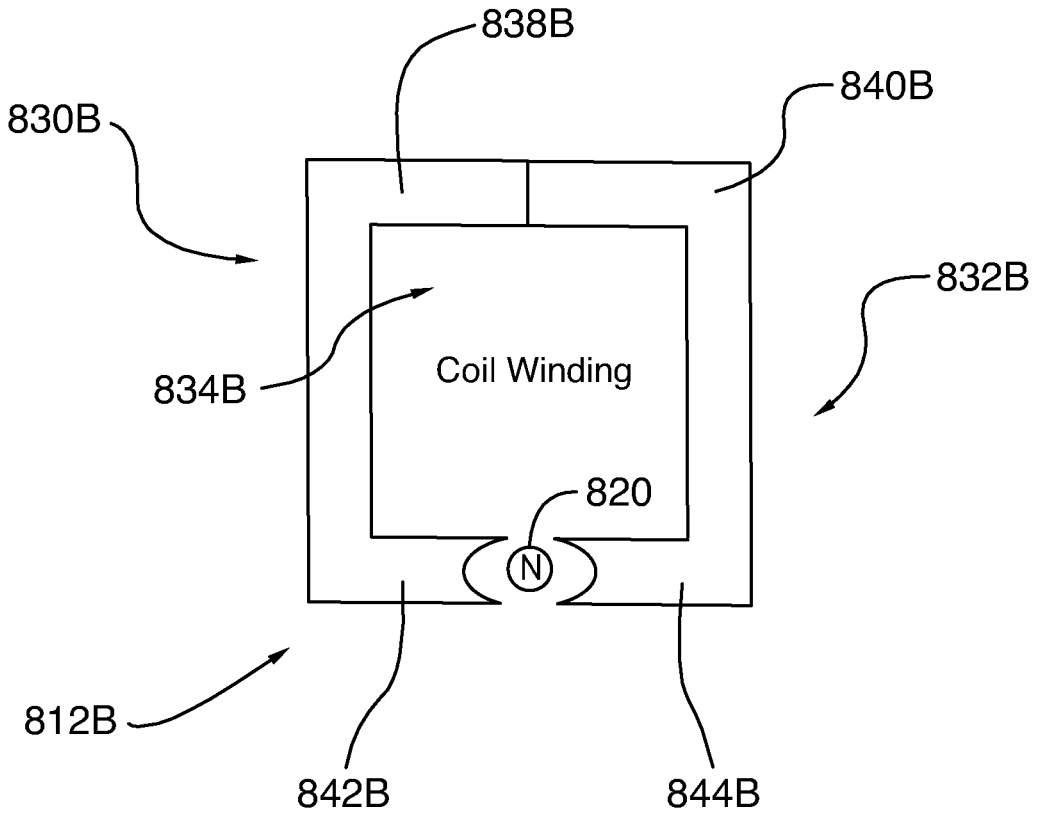
FIG. 36 illustrates in diagrammatic form another example toroid electromagnetic structure with a similar view as FIG. 13, for the device shown in FIG. 29, in accordance with another example embodiment.
Figure 37:
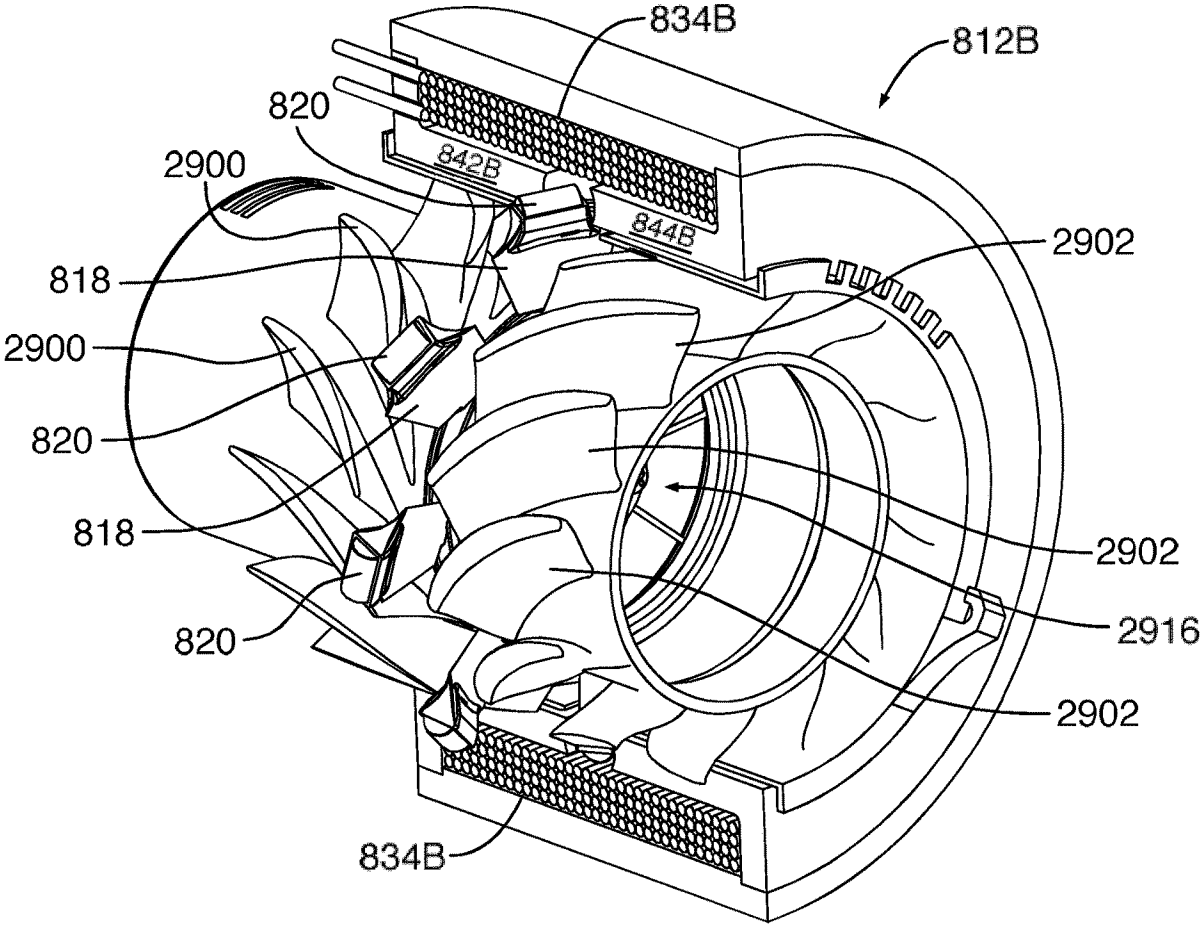
FIG. 37 illustrates a cutaway perspective view of the device shown in FIG. 29.

FIG. 36 illustrates another example toroid coil of an electromagnet 812B with a similar view as FIG. 13, for use in the device shown in FIG. 29, in accordance with another example embodiment. This electromagnet 812B can be used instead of the above-described electromagnet 812, for example. The electromagnet 812B is shown as first toroid half 830B and second toroid half 832B for circumferentially surrounding the blades 818 (FIG. 29). A coil winding 834B surrounds the toroid halves. The toroid halves 830B, 832B contact each other on the respective outside diameter 838B, 840B, but the poles do not contact each other on the inside diameters 842B, 844B. The inside diameters 842B, 844B are of a concave shape which encompass or nest the magnet 820 of the blade 818 (FIG. 29), with sufficient clearance room for twisting blade angles, for example. For example, this may provide a stronger magnetic field to magnetically affect the magnets 820.

Referring now to FIG. 29, at the exterior housing 802 side, there is illustrated a plurality of housing mounted stator vanes 2900 (one shown in FIG. 29). At the interior housing 804 side, there is also a second plurality of housing mounted stator vanes 2902 (one shown in FIG. 29). As shown in FIGS. 30 and 31, the plurality of stator vanes 2900, 2902 further guide both the positive and negative flows for the range of positive and negative blade angles.

The rotor 2916 further defines a circumferential reference to which a circumferential reference plane 2904 defines a zero angle reference 2914, as shown in FIG. 29. For example, each blade 818 is controllable by the electromagnet 812 to be angled in a range of positive and negative blade angles with respect to the zero angle reference 2914.

In the example embodiment shown in FIG. 30, the blades 818 are fixedly mounted to the rotor 2916 (FIG. 29), and can be made of resilient material so as to be twisted to the specified positive and negative angles. In other example embodiments, not shown, the blades 818 are pivotally mounted to the rotor 2916, and are rotated to the specified positive and negative angles to generated the specified frequency or frequencies.

In some example embodiments, the first plurality of stator vanes 2900 is circumferentially offset from the second plurality of housing mounted stator vanes 2902, with respect to the circumferential reference defined by the rotor 2916 (FIG. 29), better illustrated in FIGS. 30 and 31. This offset may, for example, assist in guiding the airflows generated regardless of whether the blades 818 are operating in the positive angles or the negative angles.

Figures 32, 33:
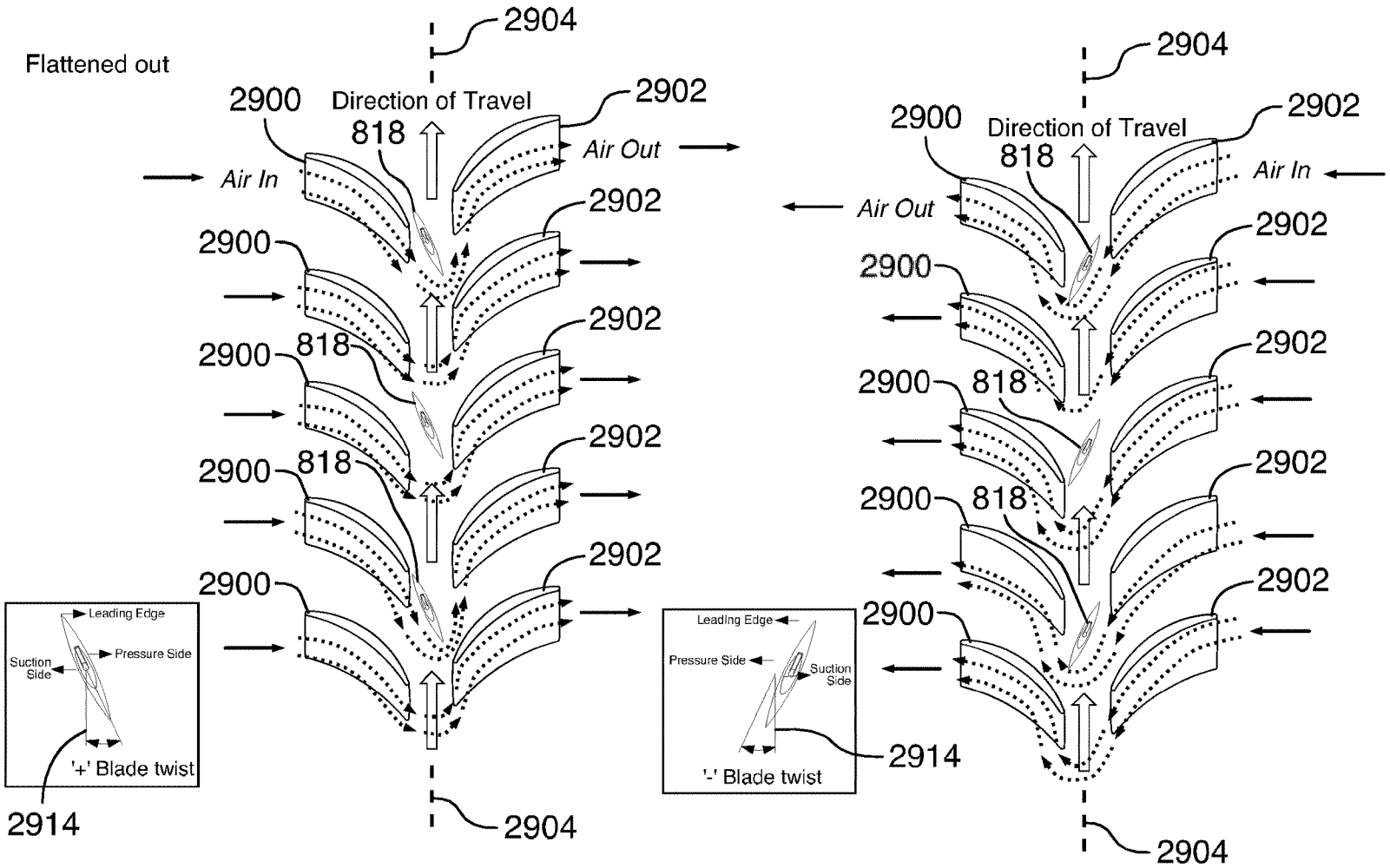
FIG. 32 illustrates in diagrammatic form a similar view as FIG. 30, circumferentially expanded (flattened out) to illustrate airflow guided in the one direction by a plurality of the stator vanes.
FIG. 33 illustrates in diagrammatic form a similar view as FIG. 31, circumferentially expanded (flattened out) to illustrate airflow guided in the opposite direction by a plurality of the stator vanes.

FIGS. 32 and 33 illustrates in diagrammatic form a similar view as FIGS. 30 and 31, respectively, but circumferentially expanded (flattened out) to illustrate airflow guided by the stator vanes 2900, 2902, to and from the blades 818. Additional flow lines are shown here for illustration of the plurality of airflows generated by the blades 818 being guided by the stator vanes 2900, 2902. For example, FIGS. 30 and 32 illustrates positive airflow lines, while FIGS. 31 and 33 illustrate negative airflow lines, as guided by the stator vanes 2900, 2902. In some example embodiments, the vane stator design may be used to provide reactive flow turning of the airflows. As can be seen from FIGS. 30 to 33, since the rotor 2916 (FIG. 29) is in fact rotating, during operation sometimes the airflows pass "over" the applicable stator vane 2900, 2902 and sometimes the airflows pass "under" the applicable stator vane 2900, 2902.

As illustrated in FIGS. 30 and 31, the first stator vanes 2900 can have a slope 2906 which are collectively positive angled with respect to the zero angle reference 2914. The second stator vanes 2902 can have a slope 2908 which are collectively negative angled with respect to the zero angle reference 2914. The relative positive and negative slopes of the stator vanes 2900, 2902 can also be reversed, in other example embodiments. The stator vanes 2900, 2902 can be sloped or curved in three dimensions (more than two dimensions), and are therefore sloped or curved with respect to the plane 2904 (zero angle reference 2914) as well as being angled with respect to a secondary reference plane, such as a tangential reference plane of the circumferential reference plane 2904.

As shown in FIGS. 30 and 31, the slopes 2906, 2908 can comprise part of a respective concave surface. As well, the stator vanes 2900, 2902 can further include a convex surface 2910, 2912 at an opposite face to the respective concave surface. In some example embodiments, the convex surface can be used for additional guiding of the airflows. In some example embodiments, the opposite angled slopes 2906, 2908 allow for guiding of both positive and negative airflows.

In some example embodiments, the stator vanes 2900, 2902 can be canted towards the rotor 2916 (FIG. 29) or plane 2904, for example. Since low noise operation of the reversible flow compressor is an important quality, in some example embodiments, the stator 2900, 2902 vanes can be canted in a tangential direction root to tip, such that the wake interaction between the stator vanes 2900, 2902 and the leading edge of the rotating blade 818 is distributed in time from the root of the blade 818 to the tip of the blade 818, rather than the interaction of the wake occurring simultaneously at all locations along the leading edge of the blades 818, which may reduce the interaction noise generated.

In some example embodiments, the static stator vanes 2900, 2902 can provide a turning action on the nominally axial flow through the blades 818 of the compressor, such that regardless of the axial direction of the flow through the blades 818 of the compressor the turning of the through airflow is always from an axial direction inwards towards the leading edge of the blades 818. Further, the vane shapes may be configured such that the rotor-induced tangential portion of the flow velocity vector downstream of each blade 818 is also turned from the rotation induced tangential direction back to an axial direction before exiting the blades 818 to the applicable flow passages 814, 816. This action may allow effective recovery of the induced tangential momentum component into axially directed momentum.

In some example embodiments, referring to FIGS. 29 to 31, the first plurality of stator vanes 2900 can comprise general mirror image shapes of the second plurality of stator vanes 2902, while still being circumferentially offset, and can generally have equal and opposite angles and slopes, for example.

In some example embodiments, the flow control device illustrated with respect to FIGS. 29 to 33 can be used to generate most any specified frequency or frequencies. For example, the device can be used to generate an infrasound frequency or at least lower in frequency than 20 Hertz. In some example embodiments, the flow control device illustrated with respect to FIGS. 29 to 33 can be used to generate a specified frequency or frequencies, include an audible frequency between 20 Hertz and 200 Hertz. Higher frequencies may also be generated from the device, for example 200 Hz to 2000 Hz, and 2000 Hz to 20000 Hz, and higher, for example. In some example embodiments, the flow control device with respect to FIGS. 29 to 33 can be used to generate steady state (DC) conditions.

In an example embodiment, the stator vanes 2900, 2902 are fixedly or statically mounted to the housing to maintain the stator vane angle. This may assist in ease of production, for example. For example, the housing along with static stator vanes 2900, 2902 may be more readily 3D printed, in some example embodiments.

In an alternate example embodiment, the stator vanes 2900, 2902 are dynamically rotatable or twistable, and can be another variable to be controlled as part of the overall control system 100, for example. For example, in some example embodiments, each stator vane 2900, 2902 may be mounted with a respective magnet, that can be controlled by the electromagnet 812B, or another electromagnet or magnetic field generating device. The first stator vanes 2900 can be dynamically controlled to have opposite varying angles to the second stator vanes 2902, in such example embodiments.

Figure 34:
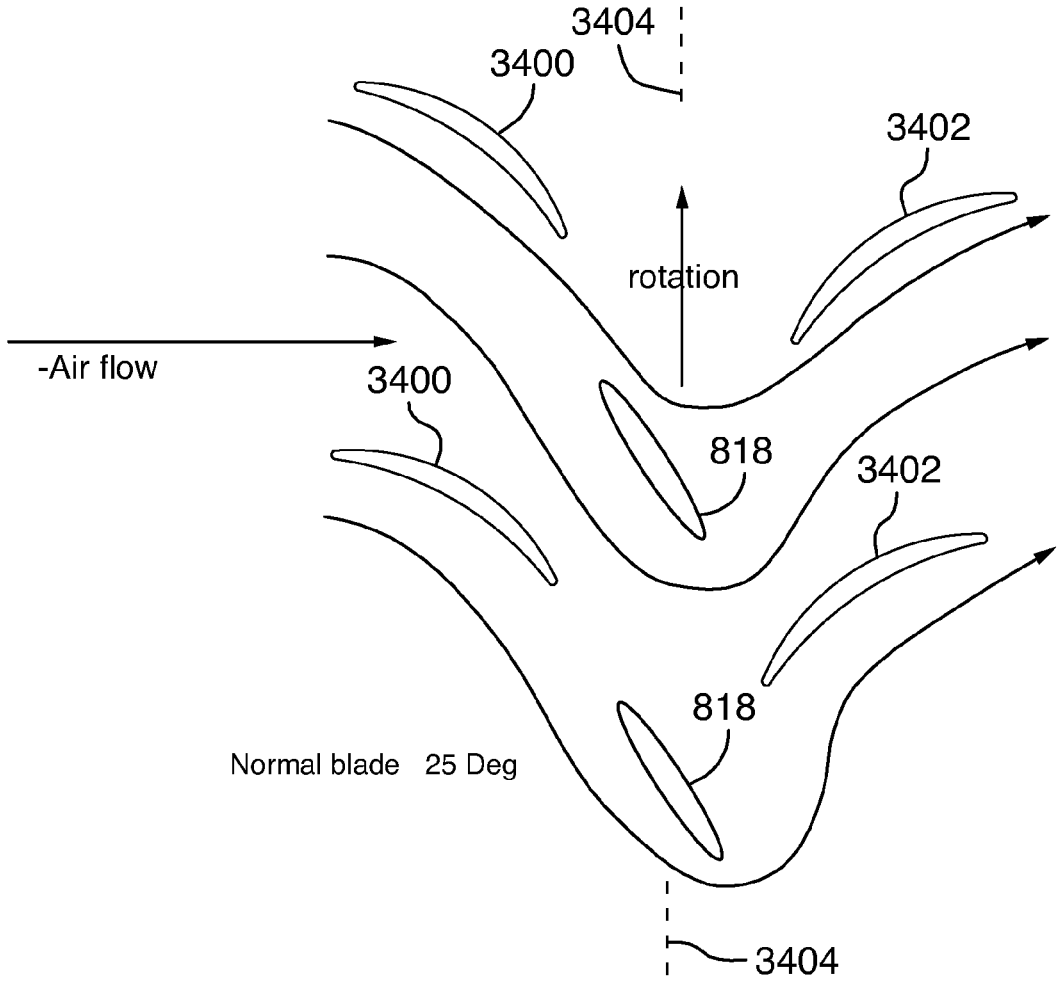
FIG. 34 illustrates, in diagrammatic form, a radially inward view of a two-way flow control device, illustrating airflow guided in one direction by stator vanes which are sloped with respect to only one reference axis, and sloped only in two dimensions, in accordance with another example embodiment.
Figure 35:
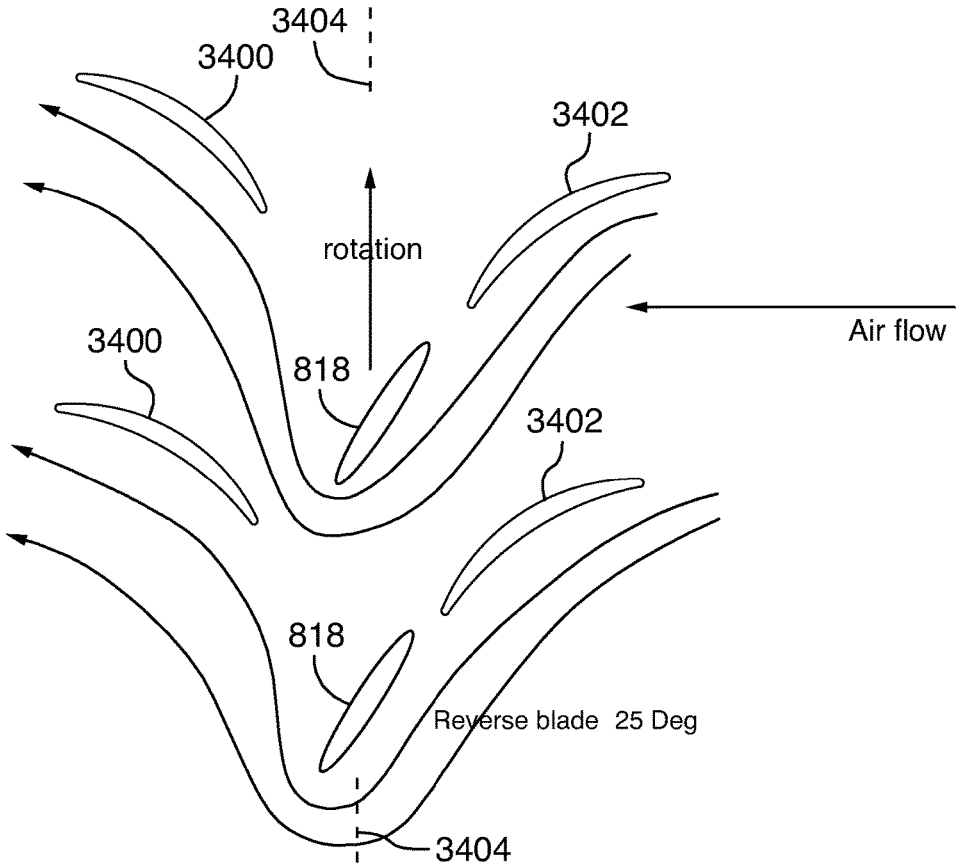
FIG. 35 illustrates the same view as FIG. 34, illustrating airflow guided in an opposite direction by the stator vanes.

FIGS. 34 and 35 illustrate, in diagrammatic form, a radially inward view of another example two-way flow control device, illustrating airflow guided by stator vanes 3400, 3402 which are sloped with respect to only one axis such as a circumferential reference axis 3404 defined by the rotor (not shown here), for example sloped in two dimensions only, in accordance with another example embodiment. In an example embodiment, as shown, the first plurality of stator vanes 3400 is circumferentially offset from the second plurality of stator vanes 3402. In an alternate example embodiment, not shown, straight angle slope(s) can be used rather than curved slopes for the stator vanes 3400, 3402.

Figure 17:
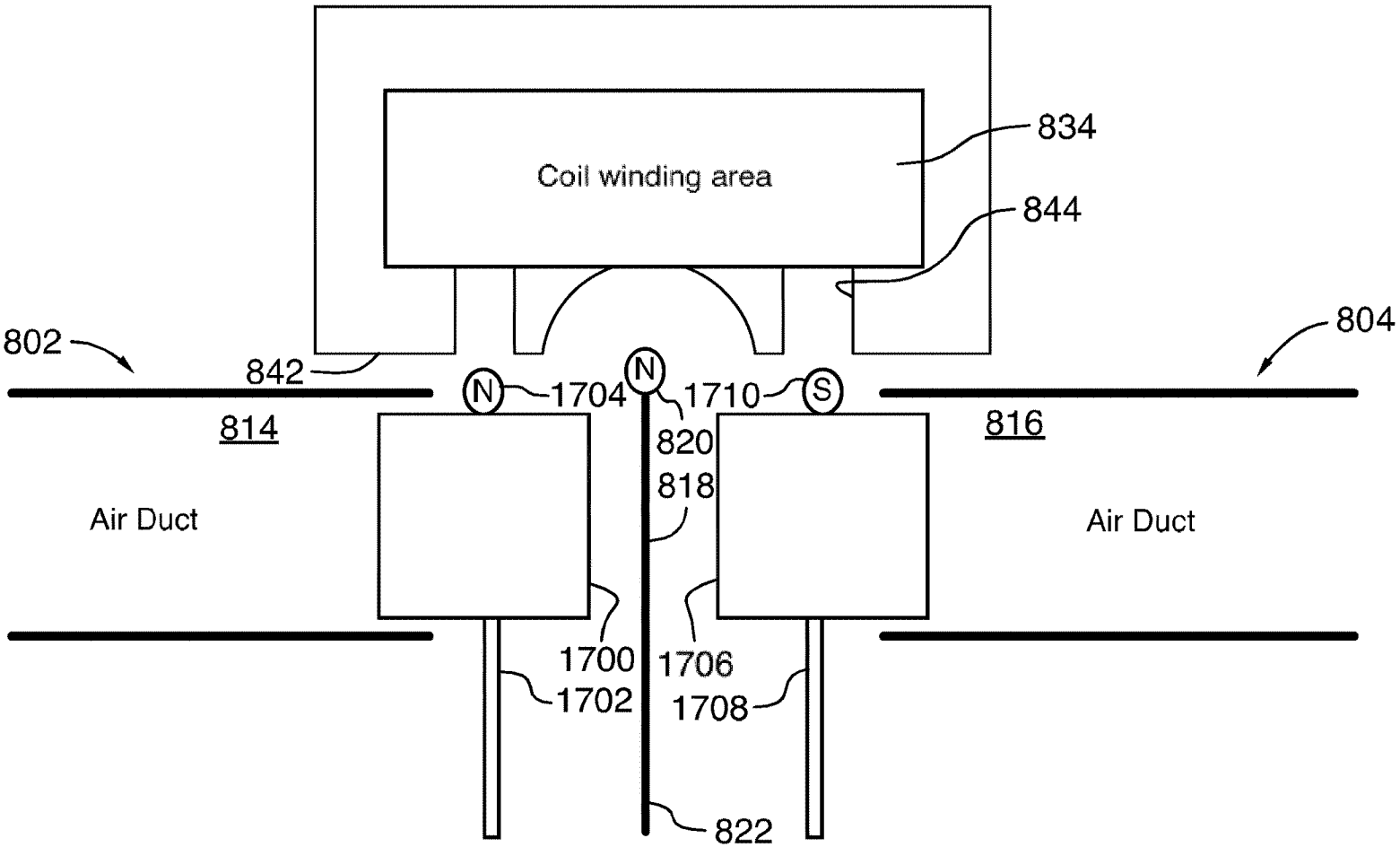
FIG. 17 illustrates in diagrammatic form another example infrasound generating compressor with a similar view as FIG. 9, in accordance with another example embodiment.

Reference is now made to FIG. 17, which illustrates an alternate example embodiment of housing mounted stator vanes 1700, 1702. Similar reference numbers are used where appropriate for convenience of reference. The example embodiment shown in FIG. 17 includes, at the exterior housing 802 side, a plurality of radially extending housing mounted stator vanes 1700 (one shown in this view), a respective vane stem 1702, and a respective magnet 1704 mounted at the end of each vane 1700. At the interior housing 804 side, there may also be a second plurality of radially extending non-rotating housing mounted stator vanes 1706 (one shown in this view), a respective vane stem 1708, and a respective magnet 1710 mounted at the end of each vane 1706.

As shown in FIG. 17, when the control current 124 in the coil 834 is at zero amps, the magnetic attraction of both poles of the spinning permanent magnets 820 mounted on the rotating blades 818 are equal to each of the poles of the inside diameters 842, 844, thus zero torque is applied to each of the blades 818, and all of the blades remain in a neutral position or zero degrees. The same is true for the variable stator vanes 1700, 1706 and their respective magnets 1704, 1706.

As the DC current in the coil 834 is increased, the magnetic poles defined by the inside diameters 842, 844 become more and more magnetized in a given polarity, North or South. This action causes the end poles of the permanent magnets 820 to become attracted to the opposite magnetic pole defined by the inside diameters 842, 844, resulting in a twisting torque being applied to each of the rotating blades 818 of the compressor disc 822 causing the blades 818 to twist a certain amount based on the torsion spring balance against the magnetic torque moment. As well, the same resultant magnetic field causes a twisting torque being applied to each of the stator vanes 1700, 1706 to twist a certain amount based on the torsion spring balance against the magnetic torque moment.

The degree of twist of each blade 818 is proportional to the magnitude of current in the coil 834. With a given polarity of current to the coil 834, the blade angle is such that airflow is forced in one direction through the air flow passages 814, 816 (all magnets are positioned with the same polarity arrangement on all blades 818), and with appropriate magnetic direction of the magnets 1704, 1710 on the stator vanes 1700, 1706, to obtain the appropriate direction of twist in each case. Applying the opposite direction of current flow in the coil 834 reverses the direction of blade or vane twist and as such airflow direction through the air flow passages 814, 816.

In an alternate example embodiment, not shown, the stator vanes 1700, 1706 are pivotally or hingedly mounted to the respective housing 802, 804. Operation of the coil 834 results in rotation of the stator vanes 1700, 1706 about a pivot point, to affect airflow in combination with the main rotating blades 818. The stator vanes 1700, 1706 can be formed of rigid or resilient material in some example embodiments. The stator vanes 1700, 1706 can be flat or curved in some example embodiments.

In some other example embodiments, not shown, the stator vanes 1700, 1706 are mounted to be circumferentially offset, and can have one of the magnets 1704, 1710 mounted in an opposite polarity, so that the stator vanes 1700, 1706 have generally equal and opposite angles.

Figure 16:
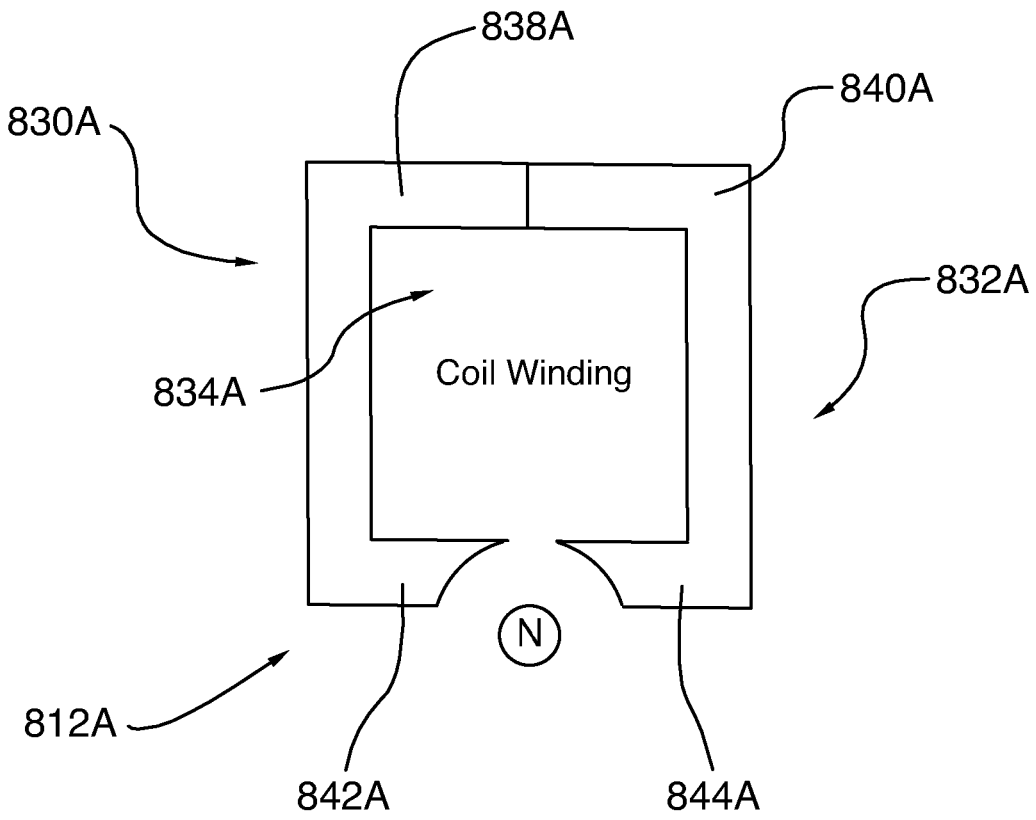
FIG. 16 illustrates in diagrammatic form another example toroid electromagnetic structure with a similar view as FIG. 13, in accordance with another example embodiment.

FIG. 16 illustrates another example toroid coil of an electromagnet 812A with a similar view as FIG. 13, in accordance with another example embodiment. This electromagnet 812A can be used instead of the above-described electromagnet 812, for example. The electromagnet 812A is shown as first toroid half 830A and second toroid half 832A for circumferentially surrounding the rotor 810. A coil winding 834A surrounds the toroid halves. The toroid halves 830A, 832A contact each other on the respective outside diameter 838A, 840A, but the poles do not contact each other on the inside diameters 842A, 844A. The inside diameters 842A, 844A are of a different shape which terminate at a point which is more radially outward, which generates a different shape of the magnetic field, as well as providing additional clearance for the blades 818, for example.

In some example embodiments, infrasound can be considered pressure changes that are at least lower in frequency than 20 Hertz or cycles per second, for example. In some example embodiments, the system 100 is able to handle frequencies which are higher or lower depending on the frequency of the original source of the pressure disturbance.

Variations may be made in some example embodiments. In some example embodiments, the described systems can be manufactured, installed, applied or retrofit to any structure, premises, or vehicle where there is infrasound or periodic variance in pressure. For example, a boat or ship which is travelling can result in pressure variances within any of the structures or rooms from the rise and fall from the waters. An air vehicle such as an airplane or helicopter may experience pressure variances within the housing frame from external natural or artificial sources and/or its own propellers.

Motion sickness can occur in a moving vehicle. For example, in McCauley et al., it was believed the predominant cause of motion sickness to be primarily from movement frequency and acceleration. For example, it has been traditionally thought that vestibular-ocular functions (inner-ear and eye co-ordination) may be disrupted based primarily on acceleration changes, such as in the vehicle. However, merely addressing these variables may be insufficient in addressing the affliction to the passenger.

In some example embodiments, there is provided systems and methods for controlling a source of physiological affliction within a moving enclosed structure, such as a vehicle. The system includes: at least one pressure fluctuation generator, at least one pressure sensor located to sense pressure indicative of the interior of the structure; and at least one controller configured to: determine, from the first pressure sensor information, at least one pressure disturbance within the interior of the structure; and control the at least one pressure fluctuation generator to cancel the at least one pressure disturbance within the interior of the structure. In an example embodiment, the at least one pressure disturbance includes infrasound. In an example embodiment, the physiological affliction includes motion sickness and/or nauseogenicity.

Physiological afflictions can occur when a vehicle is moving. It is recognized herein that pressure fluctuations can be a contributing, and often primary, cause of these physiological afflictions.

An example model for Motion Sickness Incidence (MSI) based on infrasonic pressure will now be described, in accordance with an example embodiment, which can be referred to as a pressure model for MSI. The example model uses at least some of the data points measured by the landmark study of McCauley et al., for example. In particular, cyclic variation in the lateral or linear velocity of a subject in a vehicle or platform in atmospheric air may also be subject to infrasonic pressure fluctuations due to the Bernoulli principle and possibly vortex shedding effects. Calculations presented can demonstrate that in McCauley et al., test subjects were exposed to infrasonic sound pressure levels in excess of 105 db at discrete frequencies between 0.063 Hz and 0.7 Hz. The infrasonic sound pressure level necessarily present in cyclic motion in free atmospheric air does not appear to have been accounted for as a nausea influencing factor in the original McCauley et al. motion sickness studies.

The potential relationship can exist between infrasound and nauseogenicity. However, infrasonic pressure fluctuations were apparently not considered in any of the motion sickness studies of the day, such as in McCauley et al. It can, however, be shown that motion in a free atmosphere will result in pressure fluctuations around the moving bodies and this is particularly well defined for vertical motion, because the Geopotential Pressure, more commonly known as Barometric Pressure, is an inverse function of altitude. The Bernoulli principle, which relates velocity and pressure to motion in a gas or fluid may also result in infrasonic pressures being developed, particularly in the case where vortex shedding or turbulence may be present in linear motion, however, for exemplary purposes the present disclosure calculates infrasound generated as a result of cyclic vertical displacement, in an example embodiment.

Vertical displacement in a cyclic pattern will result in the subject involved in the motion being exposed to a variation in the barometric pressure as an inverse function of the vertical displacement. Motion sickness trials have not taken this potential biodynamic stimulus into account when investigating vertical motion sickness and nausea, but appear to have paid closer attention to other variables, such as the acceleration and frequency effects. In more recent times, infrasound has been implicated in various complaints related to discomfort and sometimes nausea, and have recently been directly compared to motion sickness symptoms.

The data from McCauley et al. is examined and remodeled in the present disclosure. Data provided by McCauley et al. in the report on test frequencies and acceleration levels have been used to back-calculate the vertical displacements and resulting infrasonic pressures to which the many test subjects were exposed during the investigation into the relationship between acceleration, frequency and Motion Sickness Incidence (MSI). It was a partial aim of the McCauley team to validate and improve a model for MSI that had been partially developed from data generated in previous investigations.

The determination of infrasonic pressure magnitudes can be calculated from the US Standard Atmosphere, (Geopotential Altitude), U.S. Government Printing Office, Washington, D.C., 1976, incorporated herein by reference. Using the information from this reference, the variation in barometric pressure for a change in vertical position of 1000 Feet is 0.53 PSI, or equivalently a change of 304.8 meters will result in a pressure change of 3654.2 Pascal's, which is about 12 Pa/meter. The whole body of a subject undergoing a +/−1 meter vertical displacement at any frequency is essentially being exposed to an infrasonic sound pressure (at the same frequency) of about 8.5 Pascal's RMS. In unweighted decibel terms this is equal to about 112 dB.

This information can be used for back-calculation of infrasonic pressure for the data from the McCauley et al. study. All of the test point motion generator settings used to develop the McCauley model (which were tabulated in appendix B of McCauley et al.) were used to calculate the vertical displacements the test subjects were exposed to, as a method of establishing the magnitude of infrasonic pressures the motion sickness subjects were exposed to during the testing that simultaneously recorded nausea (actually emesis).

The vertical displacements were calculated by extracting the second integral of acceleration with reference to frequency (1.1).

The test subject displacement is calculated by:

$$D = \frac{a}{\omega^2} \tag{1.1}$$

where: D: is displacement;

a: is acceleration in g's:

$$1.0\ \mathrm{g} = 9.806\frac{\mathrm{m}}{\mathrm{Sec}^2};$$

ω: is 2πf: f is the frequency of the acceleration in Hz.

Figure 21:
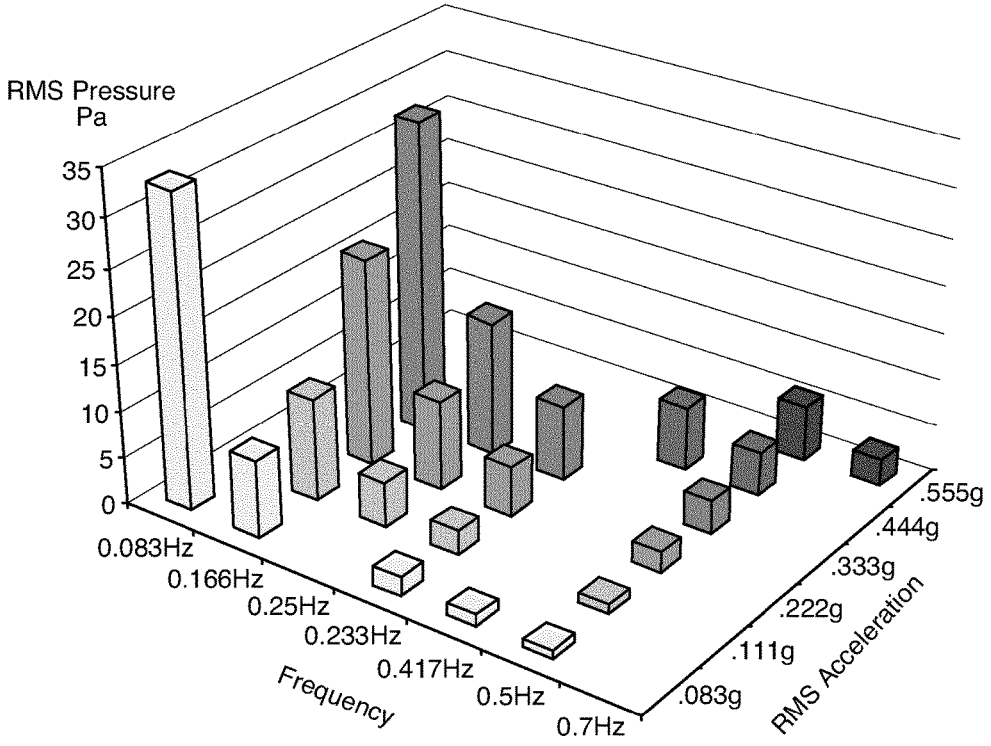
FIG. 21 illustrates a 3D bar graph of back-calculated results of a Motion Sickness Incidence (MSI) pressure model in accordance with an example embodiment, for all data points provided by McCauley et al.

FIG. 21 is a 3D bar graph of the results of the infrasonic pressure calculations for all points provided in McCauley et al., appendix B. FIG. 21 represents the results of back-calculating the vertical displacement and the resulting infrasound pressures (y axis), from the frequency (x axis) and acceleration data (z axis) provided in appendix B of McCauley et al., by applying equation 1.2 which converts cyclic vertical displacement into the resulting infrasonic pressure.

The infrasonic pressure magnitude p is calculated by:

$$p = 11.99\frac{a}{\omega^2} \tag{1.2}$$

where:

p: is the cyclic pressure change in Pascal's due to a cyclic change in vertical position.

The 0.166 Hz line is of particular interest in the graph of FIG. 21, since it is the highest infrasound pressure at any given acceleration level except for a single point at 0.083 Hz (5 CPM) where a very low subject response was measured.

Figure 22:
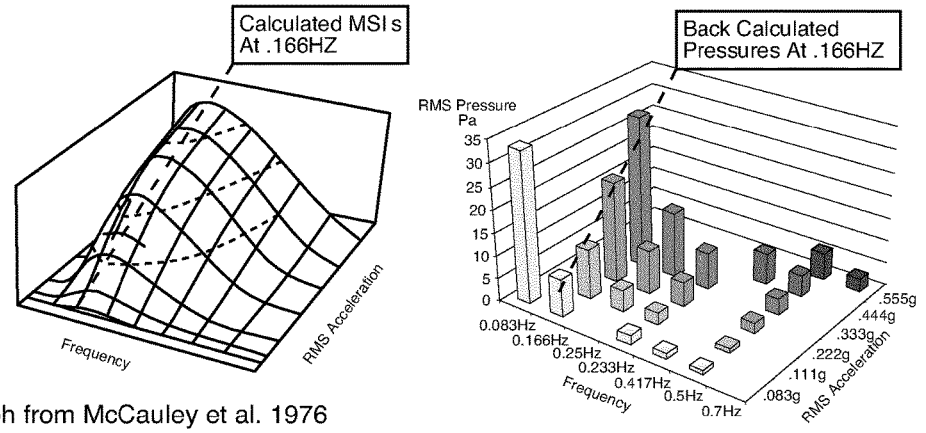
FIG. 22 illustrates a side-by-side comparison between a MSI Model of McCauley et al. on acceleration and frequency (left) and the MSI pressure model in accordance with an example embodiment (right)

Referring now to FIG. 22, a 3D graph of the McCauley model output is shown in comparison to the back-calculated infrasonic pressure values from the various test points used to develop the McCauley model. The McCauley model was developed based on the nauseogenic response of about 2000 test subjects. The 3D graph from McCauley et al. (left image of FIG. 22), shows an exaggerated nauseogenicity at exactly the frequency which would have consistently produced the highest infrasonic pressure values for a given acceleration, based on the motion generator settings used during the study. The McCauley study did show a response at a single point below 0.167 Hz frequency which was a 5% MSI at 0.083 Hz after 115 minutes. The general trend indicated by the McCauley et al. MSI model is clearly present in the infrasound pressure graph of FIG. 21.

As shown in FIG. 22, the comparisons between the McCauley model for MSI based on acceleration and frequency (left), to the back calculated pressures (right), based on the data points used to develop the McCauley model, show that the maximum nauseogenicity at about 0.166 Hz is coincident with the maximum infrasonic pressure levels that the test subjects were exposed to above about 0.09 Hz (5.4 CPM).

The model for MSI based on Infrasonic Pressure alone will now be described in greater detail, in accordance with an example embodiment. The strong similarity (FIG. 22) between the MSI of McCauley et al. and the back-calculated infrasonic pressure data at the most sensitive frequency (0.166 Hz) and the general similarity of the trends at all frequencies between the data sets, prompted a study to evaluate the potential accuracy of a simple model developed here to express MSI as a function of exposure to infrasonic pressure only (no acceleration motion), as given by:

$$\mathrm{MSI}=kPf^{1/x}\ln(t) \tag{2.1}$$

where:

P is the RMS pressure Pa;

f is frequency of displacement;

t is the exposure time in minutes;

k is a proportionality factor, such as 1.8;

x is a constant, such as 2; and

MSI is Motion Sickness Incidence in %.

Equation 2.1 was developed with the availability of the MSI response data provided in McCauley et al., appendix B, and the understanding provided by McCauley et al. that the log of exposure time appeared to have a material influence on MSI.

Figure 23:
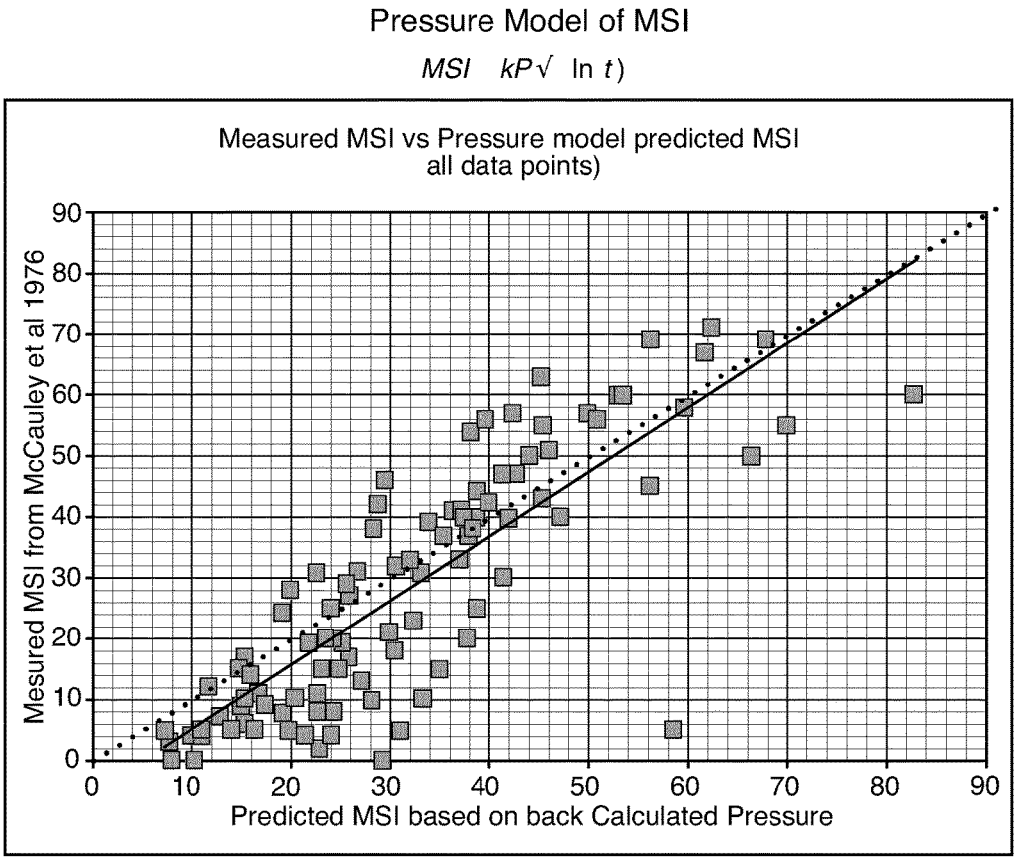
FIG. 23 illustrates measured MSI for all data points from McCauley et al. plotted against the MSI pressure model.
Figure 24:
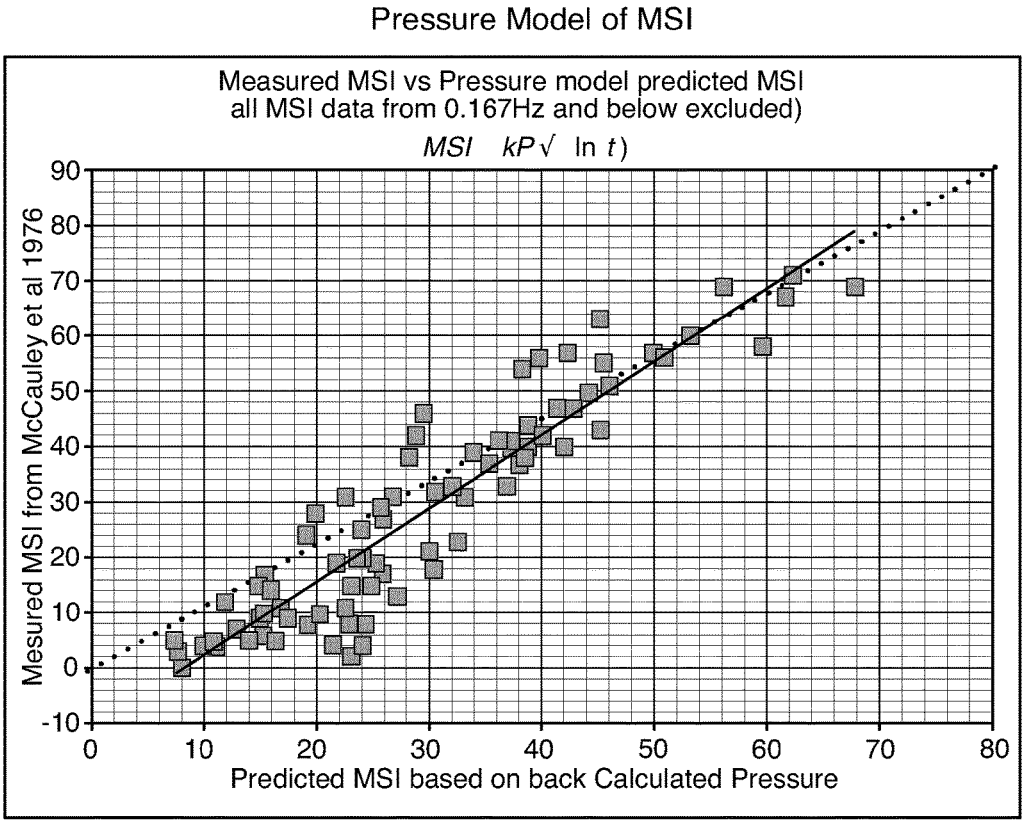
FIG. 24 illustrates measured MSI for data points from McCauley et al., with data points from 0.167 Hz and below excluded, plotted against the MSI pressure model.

FIG. 23 and FIG. 24 are graphic results of a comparison between the simple infrasonic pressure based MSI model of equation 2.1 and real MSI results from McCauley et al., appendix B.

Figure 25:
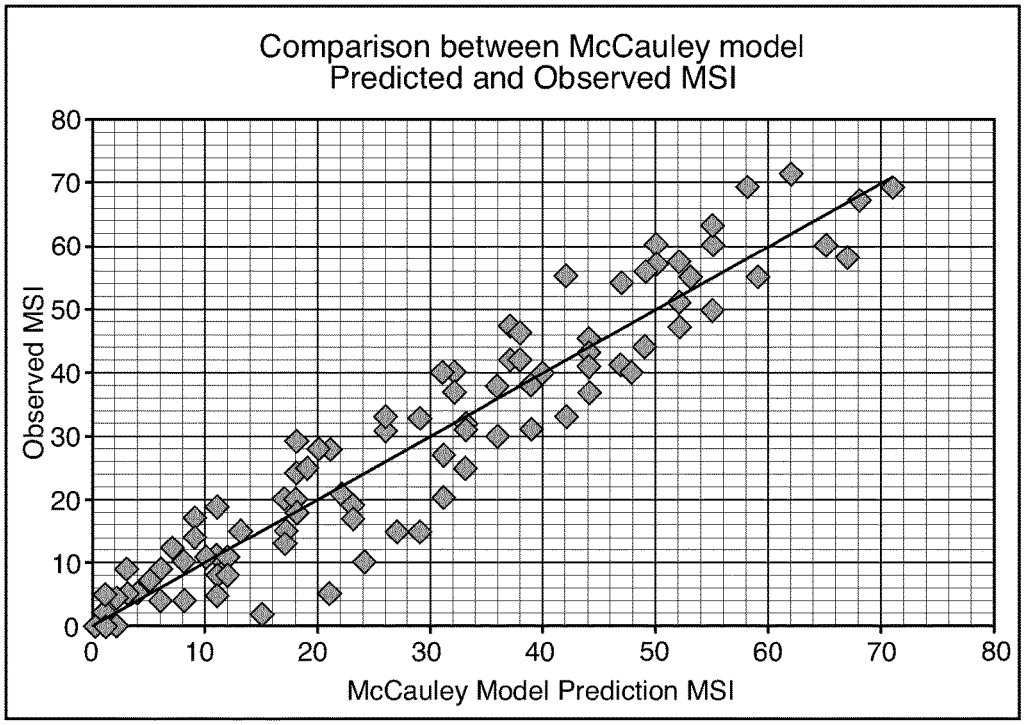
FIG. 25 illustrates a comparison between the predicted MSI model of McCauley et al. (x-axis) versus the MSI values observed by McCauley et al. (y-axis)

FIG. 23 is the graph of the complete data set from McCauley et al., appendix B that was used to develop the McCauley model, FIG. 24 is the same data except with the 0.167 Hz and below data points removed, FIG. 25 is a similar graph showing the McCauley et al. predictions versus the observed MSI.

The 0.167 Hz data points were excluded in the FIG. 24 graph because close examination of the MSI data (FIG. 26 and FIG. 27) seems to reveal a discontinuity when comparing observed MSI to pressure. The discontinuity is limited to the 0.167 Hz data (this is based on the assumption that the presented hypothesis is correct).

The apparent "resonance" at 0.166 Hz shown in the McCauley 3D graph (FIG. 22), also does not seem to be the cause of the discontinuity, since the McCauley et al. data is lower at the 0.166 Hz frequency than the MSI infrasonic pressure model (2.1) predicts it would be. The possibility that the test chamber leakage rate suddenly changed as the g level was increased from 0.111 g to 0.222 g (the response in MSI jumped up by a factor of at least 10 at this transition), or that an undetected Helmholtz resonance was altered cannot be discounted. The McCauley et al. data table did not include MSI data at the 15 minute exposure interval for the 0.111 g acceleration level, so it may have actually been zero (i.e. no MSI response from test subjects).

Figure 26:
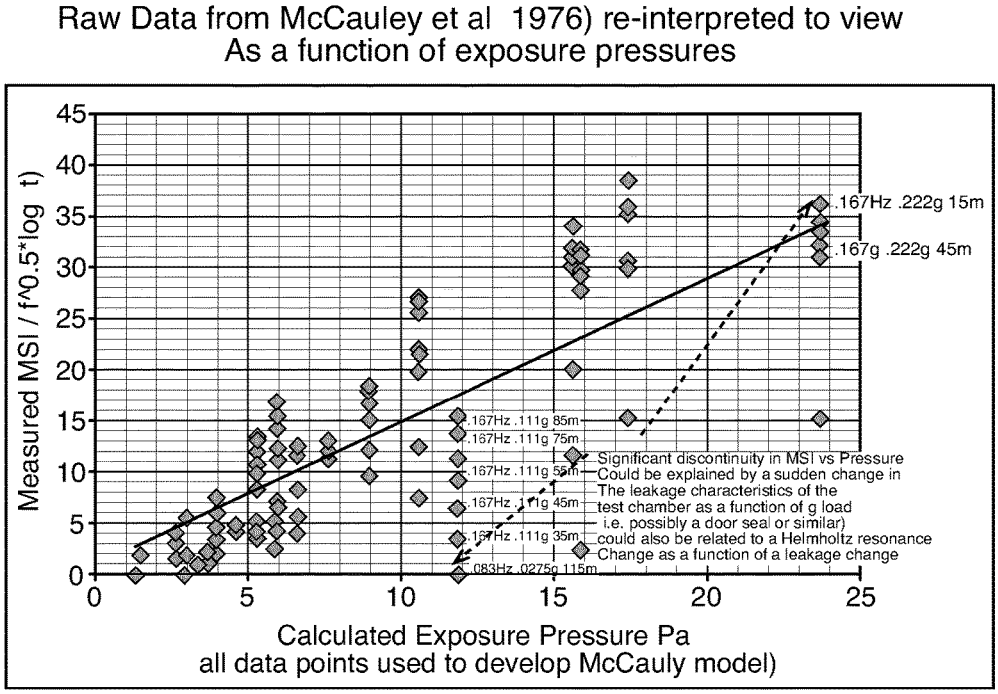
FIG. 26 illustrates a comparison between the MSI pressure model in accordance with an example embodiment (x-axis) versus MSI values observed by McCauley et al., for all data points (y-axis)

FIG. 23 is a graph of all MSI experimental data provided in appendix B of McCauley et al. plotted against the presently described MSI infrasonic pressure model. The dotted line on the graph is the pressure model predictions (based on subject exposure to infrasonic pressure alone). The solid line is the mean value of all data points based on infrasonic pressure. It was noticed during examination of the data as a function of calculated pressure, that an apparent discontinuity was exhibited in the 0.167 Hz data alone (FIG. 26).

The data is re-plotted in FIG. 24 with the 0.167 Hz and below data points excluded. FIG. 24 is a graph of all MSI experimental data provided in appendix B of McCauley et al., except data at 0.167 Hz and below have been excluded. The experimental MSI responses are plotted against the MSI pressure model described herein. The dotted line on the graph is the pressure model prediction (based on subject exposure to infrasonic pressure alone). The solid line is the mean value of all data points included, based on the pressure model.

The graph of FIG. 25 shows the comparison between the McCauley et al. model predicted MSI (x-axis) versus the observed MSI values (y-axis). The complicated McCauley et al. MSI model is calculated as follows:

$$MSI=\frac{100}{2\pi\sigma_a\sigma_t\sqrt{1-\rho^2}}\int_{-\infty}^{\log_{10}a}\int_{-\infty}^{\log_{10}t}\exp\left\{\frac{-1}{2(1-\rho^2)}\left[\left(\frac{x-\mu_a(f)}{\sigma_a}\right)^2-2\rho\left(\frac{x-\mu_a(f)}{\sigma_a}\right)\left(\frac{y-\mu_t}{\sigma_t}\right)+\left(\frac{y-\mu_t}{\sigma_t}\right)^2\right]\right\}dydx=100\Phi(a,t)$$

By way of comparison, the Pressure Model for MSI is provided as follows, in accordance with an example embodiment:

$$MSI=1.8\ Pf^{\frac{1}{x}}\ln(t)$$

where:

P is the RMS pressure Pa;

f is frequency of displacement;

t is the exposure time in minutes;

x is a constant, such as 2; and

MSI is Motion Sickness Incidence %.

By comparing with the McCauley et al. MSI model, the simplicity can be seen in the presented MSI pressure model, in accordance with an example embodiment.

A potential discontinuity in data was observed in the 0.167 Hz data set. The potential discontinuity is revealed when analyzing MSI data as a function of back-calculated pressure related to vertical motion versus MSI divided by f^0.5*log (t), which is effectively an alternate method of back calculation of un-scaled pressure based on the hypothesis presented.

FIG. 26 is a graph of all MSI data provided in McCauley et al., appendix B, which were used to develop the McCauley model for MSI and were used here to calibrate the Pressure model for MSI. The MSI data has been divided by log time and square root of frequency. A discontinuity seems to show up in the MSI response data from the 0.167 Hz data group (no 15 minute point at 0.111 g and 0.167 Hz included in the McCauley et al data).

The MSI response jumps up by a factor of ten between the 0.167 Hz at 0.111 g and the 0.167 Hz at 0.222 g (see arrows on graph).

This result could be explained by a sudden increase in the leakage rate of the test subject compartment of the motion generator at 0.222 g, or possibly a change in a Helmholtz resonance due to a change in leakage characteristics at one of the conditions. Since the equipment was not designed with pressure response to the environment as a design parameter, this explanation may be reasonable.

Figure 27:
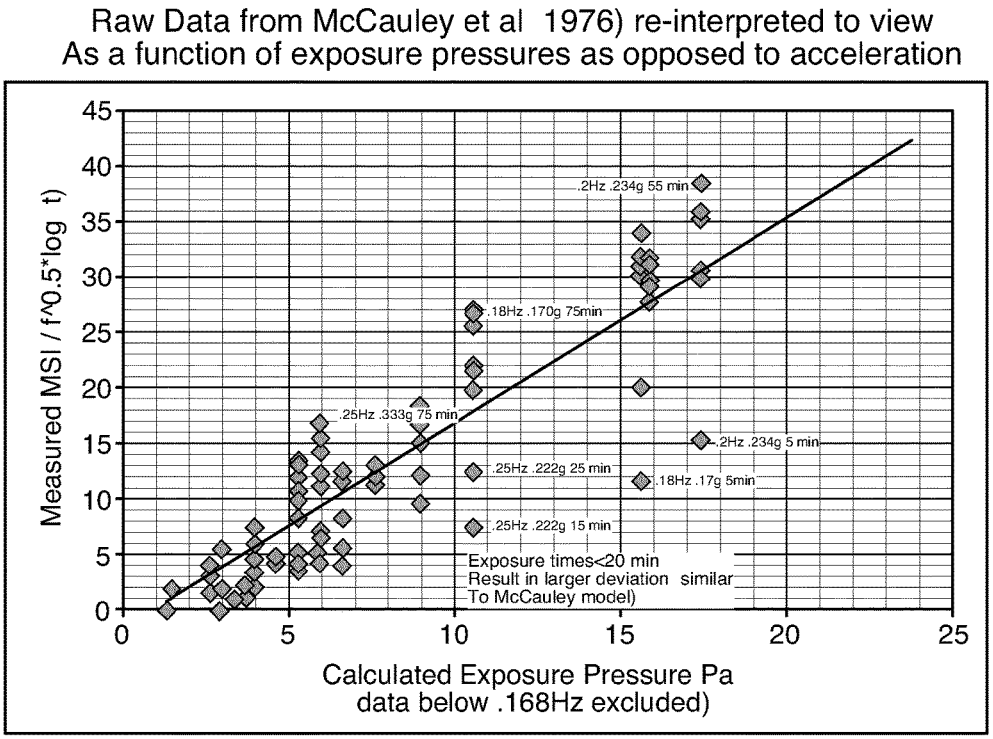
FIG. 27 illustrates a comparison between the MSI pressure model in accordance with an example embodiment (x-axis) versus the MSI values observed by McCauley et al., with data points from 0.167 Hz and below excluded (y-axis)

FIG. 27 is a graph similar to FIG. 26 except the 0.167 Hz data has been excluded. This illustrates the possible discontinuity of the 0.167 Hz experimental data, by significantly reducing the scatter between experimentally measured pressure (based on the hypothesis) and MSI, and calculated infrasonic pressure fluctuations based on vertical motion.

In general the simple pressure model provided, in accordance with some example embodiments, correlates well with the experimental data from McCauley et al. as shown by FIG. 23. A reduced overall scatter is realized when apparently discontinuous data points from 0.167 Hz are excluded as shown by FIG. 24. The slight droop in MSI data in the lower pressure range relative to calculated values visible in FIGS. 23 and 24, could easily be explained as being due to the slower pressure equalization time of the test compartment with the outside infrasonic pressure, at lower pressure differentials (i.e. partial compartment sealing). The infrasonic pressure model for MSI (or nausea) developed here may provide insight into several areas.

The pressure model for MSI can be applied to improving the comfort of passengers and crew in ships or other vehicles, a semi-sealed compartment where the external infrasound levels due to vertical (or other) motion may be prevented from communicating to the inside of the compartment easily, or an active infrasound cancellation system may be employed to attenuate the infrasonic pressures.

The simplicity and accuracy of the pressure model for MSI relative to the existing MSI model (FIG. 25), in conjunction with separate reports of infrasound related nausea and discomfort, tends to support the validity of the model concept.

Calculations of MSI for much lower infrasonic pressure levels over significantly longer time periods reveal an interesting trend. A calculation performed at 0.72 Hz with an un-weighted SPL of 60 dB yields an MSI of 0.35% after 2.5 months. At 20 Hz and the same SPL of 60 dB the model predicts an MSI of 1.9% after 2.5 Months.

As well, it is recognized that an individual may have an increased tendency to fall asleep in the presence of infrasound has a significantly higher probability than without infrasound, which is undesirable for a driver of a vehicle, for example. Infrasound may also impair mental cognitive function and task effectiveness, for example. These afflictions can also be present when in a moving vehicle, as a result of infrasound disruptions due to the movement of the vehicle.

Figure 18:
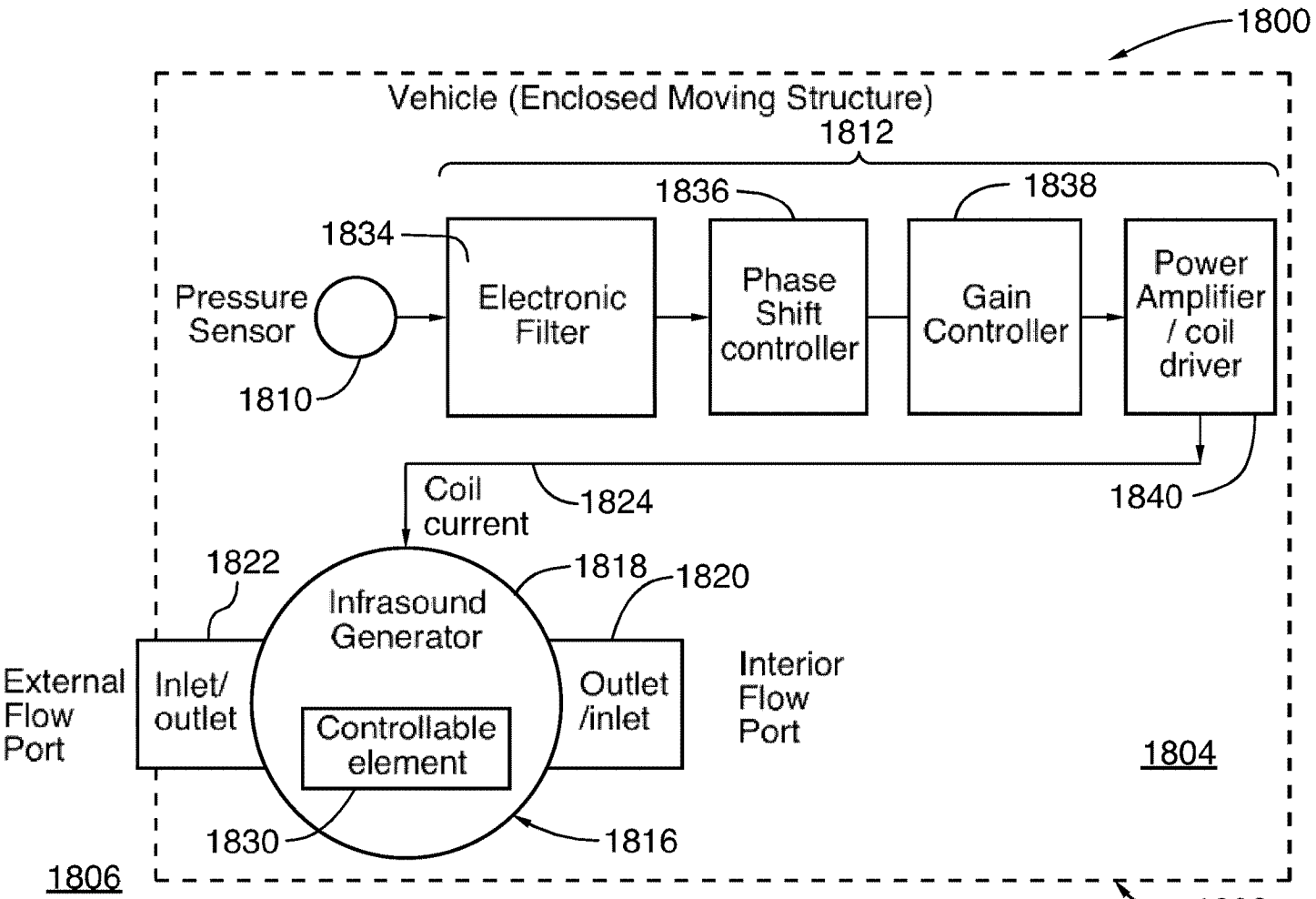
FIG. 18 illustrates a detailed block diagram of an example system configured to control at least one pressure disruption inside a structure, in accordance with another example embodiment.

Reference is now made to FIG. 18, which illustrates a detailed block diagram of an example system 1800 configured to control a source of physiological affliction from pressure disruptions within an enclosed moving structure 1802, such as part or all of a vehicle, in accordance with an example embodiment. Moving as referred to herein includes displacement or traversal of the structure 1802, rather than merely vibration, etc.

The vehicle can be, for example, a car, bus, truck, boat, etc. The structure 1802 can be, in some example embodiments, one room or cabin of a boat or vessel with the door closed, an interior of a passenger car with the windows up, or any generally enclosed space which is typically occupied by a passenger and of a sufficiently small size that can have the pressure controlled by at least one infrasound pressure generator. By way of example, a passenger car can be on or about 3 cubic meters, a passenger bus can be on or about 30 cubic meters, and a boat cabin can be on or about 50 cubic meters.

In some example embodiments, the system 1800 can require as little as one internal pressure sensor in some instances, depending on the relatively small size of the structure 1802. In some example embodiments, infrasound can occur within these vehicles, and many other moving structures, due to vertical displacement and change in Barometric Pressure, even without an external source of infrasound disturbance. In some example embodiments, the physiological affliction includes at least one of discomfort, motion sickness, nauseogenicity, mental cognition, and tendency to sleep, of an occupant within the structure 1802.

As shown in FIG. 18, the structure 1802 can be part of a vehicle and can define an interior 1804 and have an associated exterior 1806. The system 1800 includes at least one infrasound generator 1816. The structure 1802 can be enclosed, and the interior 1804 can be of a relatively small space so that it can be controlled by the at least one infrasound generator 1816. For larger sizes of the interior 1804, multiple infrasound generators 1816 can be sound with their pressure fluctuation generations coordinated appropriately. While the generator 1816 is illustrated as being located in the interior 1804 of the structure 1802, in other example embodiments the generator 1816 is located at the exterior 1806 of the structure, with the interior opening interface 1820 interfacing with the interior 1804 from the outside.

At least one pressure sensor 1810 is located to sense pressure indicative of the interior 1804 of the structure 1802, and provide a signal representative thereof. For example, the pressure sensor 1810 can be located in the interior 1804. For example, the pressure sensor 1810 can be the pressure sensor 700 (FIG. 7). At least one controller 1812 can be configured to: determine, from pressure sensor information of the pressure sensor 1810, at least one infrasound disturbance within the interior 1804 of the structure 1802. The at least one controller 1812 can be configured to control the at least one infrasound generator 1816 to cancel the at least one infrasound disturbance within the interior 1804 of the structure 1802.

The at least one controller 1812 can include an electronic filter 1834, a gain controller 1838, and an amplifier 1840, in some example embodiments. The electronic filter 1834 can be one or more band-pass or lowpass filters to filter at least one or numerous harmonics, including a fundamental harmonic, second harmonic, third harmonic, etc. The gain controller 1838 is configured for determining and applying the amount of gain to the signal. The signal from the gain controller 1838 is fed to the amplifier 1840, to cancel the pressure oscillations within the interior 1804, representative of the one or more harmonic frequencies. A control loop can be used to determine the amount of gain required. If needed, a phase shift controller 1836 can also be used, depending on the requirements of the system 1800, to compensate for system lag, to account for the location of the pressure sensor 1810, for example.

As shown in FIG. 18, the at least one infrasound generator 1816 includes a housing 1818 which defines an interior opening interface 1820 open to the interior 1804 of the structure 1802 and an exterior opening interface open 1822 to the exterior 1806 of the structure 1802. The infrasound generator 1816 includes a controllable element 1830, such as the coil current 1824 to an electromagnetic coil, in order to produce the infrasound which negatives the infrasound disruption in the interior 1804.

In some example embodiments, the system 1800 and the infrasound generator 1816 of FIG. 18 is embodied by at least some or all of the system 100 and the reversible compressor 116, described in detail herein in relation to at least FIG. 2.

The at least one controller 1812 can also calculate an amount of motion sickness, such as the Motion Sickness Incidence using the MSI pressure model described herein, due to the at least one infrasound disturbance within the interior of the structure 1802. For example, equation 2.1 can be used. A user interface can be provided which advises the user (e.g. vehicle driver) of the amount of infrasound present, the amount of motion sickness, as well as the new (reduced) amount of infrasound present based on the cancellation of the infrasound, as well as the new (reduced) amount of motion sickness. Other information can also be provided through the user interface, depending on the particular type of information desired. Once the value(s) of MSI are determined, these value(s) of MSI can be output, tracked, saved, used for present or future analytics, and/or sent to another device, for example.

Figure 19:
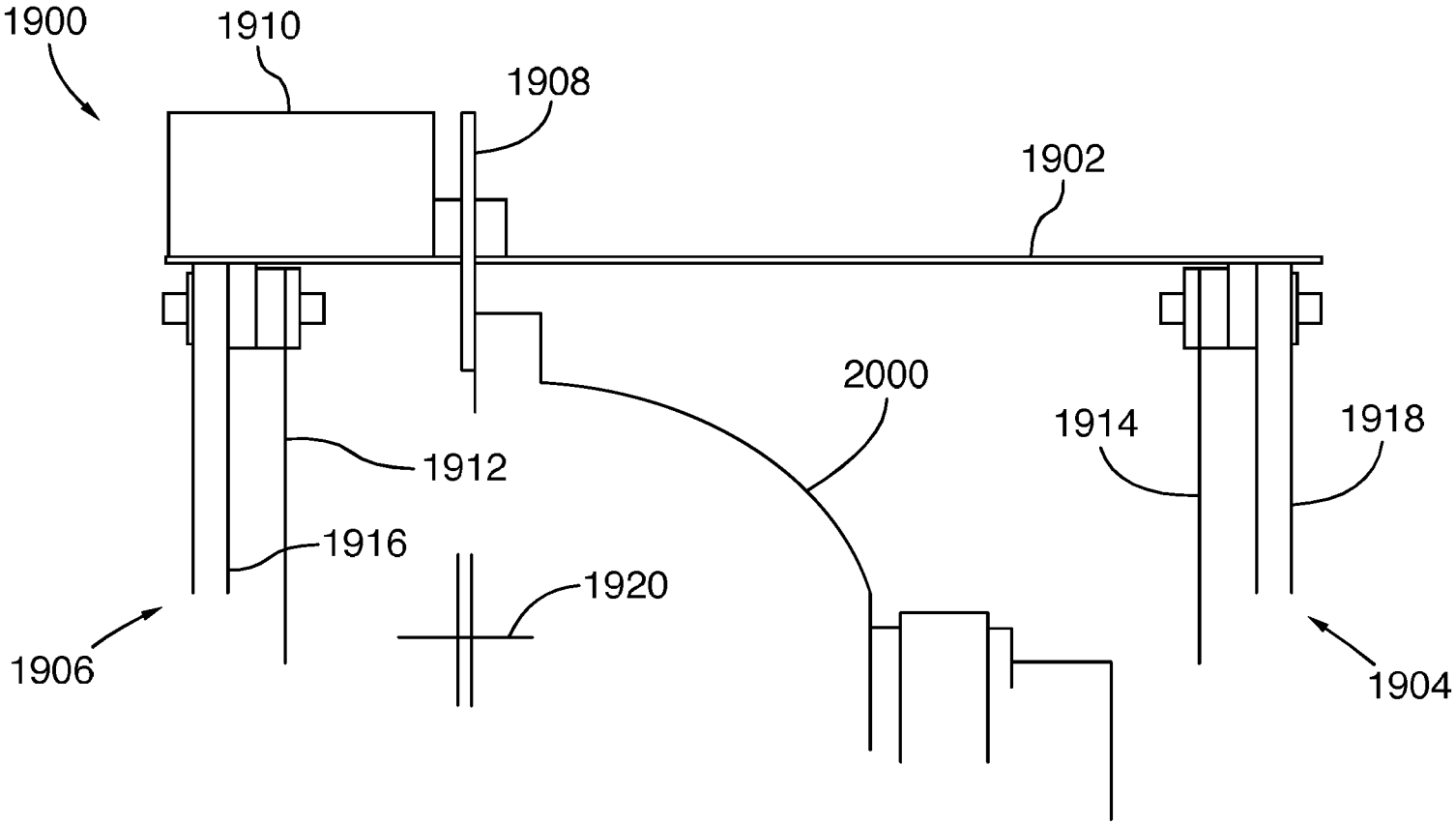
FIG. 19 illustrates in diagrammatic form a partial top-half cross section of an example infrasound generator, in accordance with an example embodiment, the remaining partial bottom-half cross-section being substantially a mirror image thereof (not shown here)

FIG. 19 illustrates another example infrasound generator 1900, in accordance with another example embodiment. The infrasound generator 1900 can be embodied as the infrasound generator 1816 in the system 1800 of FIG. 18, or the reversible compressor unit 118 of FIG. 2, for example. The infrasound generator 1900 can include a sub-audible frequency speaker, such as 20 Hz or lower.

The infrasound generator 1900 includes a suitable speaker 2000 or similar type oscillating device which can be controlled to provide pressure fluctuations to cancel any pressure fluctuation disturbances. A housing 1902 or duct houses the speaker 200, and defines an interior opening interface 1904 open to the interior 1804 of the structure 1802 (FIG. 18), and an exterior opening interface 1906 open to the exterior 1806 of the structure 1802 (FIG. 18). This contrasts, for example, with typical conventional speakers which have an enclosed cabinet with only one open end to emanate sound.

The speaker 2000 is supported by a mount 1908, which can be a flange. The mount 1908 can also be used to mount the generator 1900 to the structure 1802 (FIG. 18). An electrical connector box 1910 can interface with, and/or include at least some of, the at least one controller 1812 (FIG. 18). Parts of the electrical connector box 1910 can be used to control the speaker 2000.

A first diaphragm 1912 is mounted at the exterior interface 1906, and a second diaphragm 1914 is mounted at the interior interface 1904. Each diaphragm 1912, 1914 can be, for example, a latex rubber membrane. The latex rubber membrane can be stretched tight, and be for example 0.01 inches. Accordingly, in some example embodiments, a conventional speaker 2000 can be used without having a leakage of air, heat, humidity or bugs, etc., from outside to inside. The diaphragm 1912, 1914 also can prevent foreign entry to the speaker 2000 and associated components, such as the speaker coil or cone. In an example embodiment, the diaphragm 1912, 1914 may form a vapor/thermal barrier, to prevent condensation on the surface of the speaker 2000. The diaphragms 1912, 1914 move or deflect when the speaker diaphragm 2012 (FIG. 20) deflects, in the same direction.

There is a substantially pressure tight seal caused by the speaker diaphragm 2012 (FIG. 20) between the interior cavity and the exterior cavity, in some example embodiments. In some example embodiments, a bleed tube 1920 can be used for gradually equalizing the pressure difference across the speaker diaphragm 2012 (FIG. 20), through very slow leakage. The bleed tube 1920 does not substantially affect the particular frequencies of operation of the speaker diaphragm 2012. In an example embodiment, a first screen 1916 and second screen 1918, such as a grill, can further be used for protection and prevention of foreign entry to affect the diaphragm 1912, 1914 or the speaker 2000.

In an example embodiment, the infrasound generator 1900 can be used for higher frequency cancellations in relatively smaller places, such as vehicles, bedrooms etc. The infrasound generator 1900 can also be used at lower frequencies, such as 20 Hz or lower.

Figure 20:
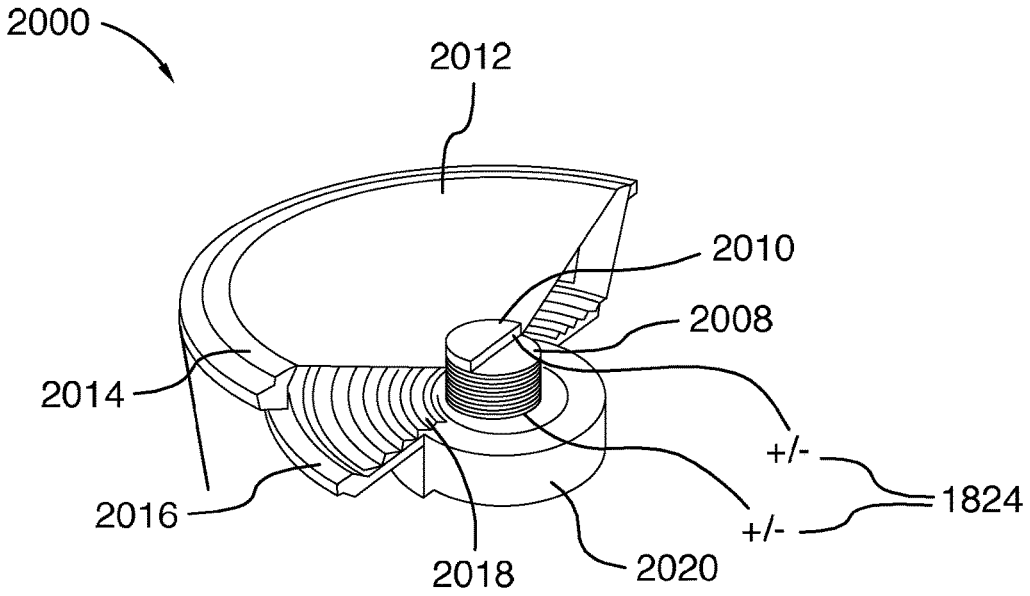
FIG. 20 illustrates a cut-away perspective view of an example speaker for the infrasound generator of FIG. 19, in accordance with an example embodiment.

FIG. 20 illustrates an example speaker 2000 for the infrasound generator 1900, in accordance with an example embodiment. The term "speaker" is used in terms of the system components for convenience of understanding, with the understanding that sub-audible pressure fluctuations can be generated. As shown in FIG. 20, the example speaker 2000 can include an electromagnetic coil 2008, sometimes referred to as a voice coil. In some example embodiments, the speaker 2000 can also include, for example, a dust cap 2010, at least one diaphragm 2012 (which can be cone-shaped), suspension 2014, basket 2016, spider 2018, and a magnet 2020. The magnet 2020 can be a permanent magnet which is supported by the spider 2018 and the basket 2016.

The electromagnetic coil 2008 can be controlled by the amplifier 1840 shown in FIG. 18, for example. When the electrical current flowing through the electromagnetic coil 2008 changes direction, the polar orientation of the coil 2008 reverses. This changes the magnetic forces between the coil 2008 and the permanent magnet 2020, moving the coil 2008 which provides motive force to the attached diaphragm 2012, which then moves back and forth. The electromagnetic coil 2008 is positioned in a constant magnetic field created by the permanent magnet 202. For example, the positive end of the electromagnetic coil 2008 is attracted to the negative pole of the permanent magnetic field, and the negative pole of the electromagnetic coil 2008 is repelled by the permanent magnet's negative pole. When the polar orientation of the electromagnetic coil 2008 switches, so does the direction of repulsion and attraction. In this way, alternating current from the amplifier 1840 (FIG. 18) constantly reverses the magnetic forces between the coil 2008 and the permanent magnet 2020. This pushes the coil 2008 back and forth rapidly.

When the coil 2008 moves, it pushes and pulls on the diaphragm 2012. This vibrates the air in front of the diaphragm 2012, creating pressure oscillations. The frequency and amplitude of the pressure change, which can be representative of the original signal from the amplifier 1840, dictates the rate and distance that the coil 2008 moves. This, in turn, determines the frequency and amplitude of the pressure oscillations produced by the diaphragm 2012.

The speaker 2000 can be controlled by way of movement of the coil 2008, so that air pressure affected at the interior opening interface 2004, to cancel any existing cyclic pressure disruptions such as infrasound.

In at least some example embodiments, there is a pressure tight seal caused by the speaker diaphragm 2012 (FIG. 20) between the interior cavity and the exterior cavity of the infrasound generator 1900 (FIG. 19). Accordingly, in some example embodiment, there is little or no air flow through the speaker diaphragm 2012 (other than, for example, the gradual bleed tube 1920 in FIG. 19, which does not substantially affect operation). In some example embodiments, the speaker diaphragm 2012 does not cause airflows through the infrasound generator 1900 as such, but rather the pressure changes are a result of variability in the inside the structure 1802, and the volume of the interior 1804 (FIG. 18) being controlled. This results in the generation of infrasound pressures to cancel the pressure disruptions. In some example embodiment, the infrasound generator 1900 can be thought of as a variable wall position, which varies the volume of the interior 1804 (FIG. 18) as the speaker diaphragm 2012 moves in and out to equalize the pressure disruptions, and as such does not substantially roll off in frequency response. Referring again to FIG. 19, in some example embodiments, note that the interior diaphragm 1914 can act as this variable "wall", which oscillates under the influence of the speaker diaphragm 2012 (FIG. 20). In some example embodiments, this operation is suited for enclosed spaces such as the relatively small vehicles or structures described herein.

Another example of an infrasound generator is a TRW-17 Thigpen Rotary Woofer, available from Eminent Technology.

Referring to FIG. 18, in this type of example infrasound generator, the electromagnet coil (voice coil) is used to control the pitch or angle of rotating blades from the centralized electromagnetic coil, in order to produce low frequencies. In example embodiments, this type of system can be configured to have a housing which defines an interior opening interface open to the interior 1804 of the structure 1802 and an exterior opening interface open to the exterior 1806 of the structure 1802, in order to cancel (equilibrate) any cyclic pressure disturbances such as infrasound within the structure 1802.

In some other example embodiments, any suitable pressure oscillation generator can be used as the infrasound generator 1816, so long as pressure fluctuations can be controlled within the interior 1804.

Figure 28:
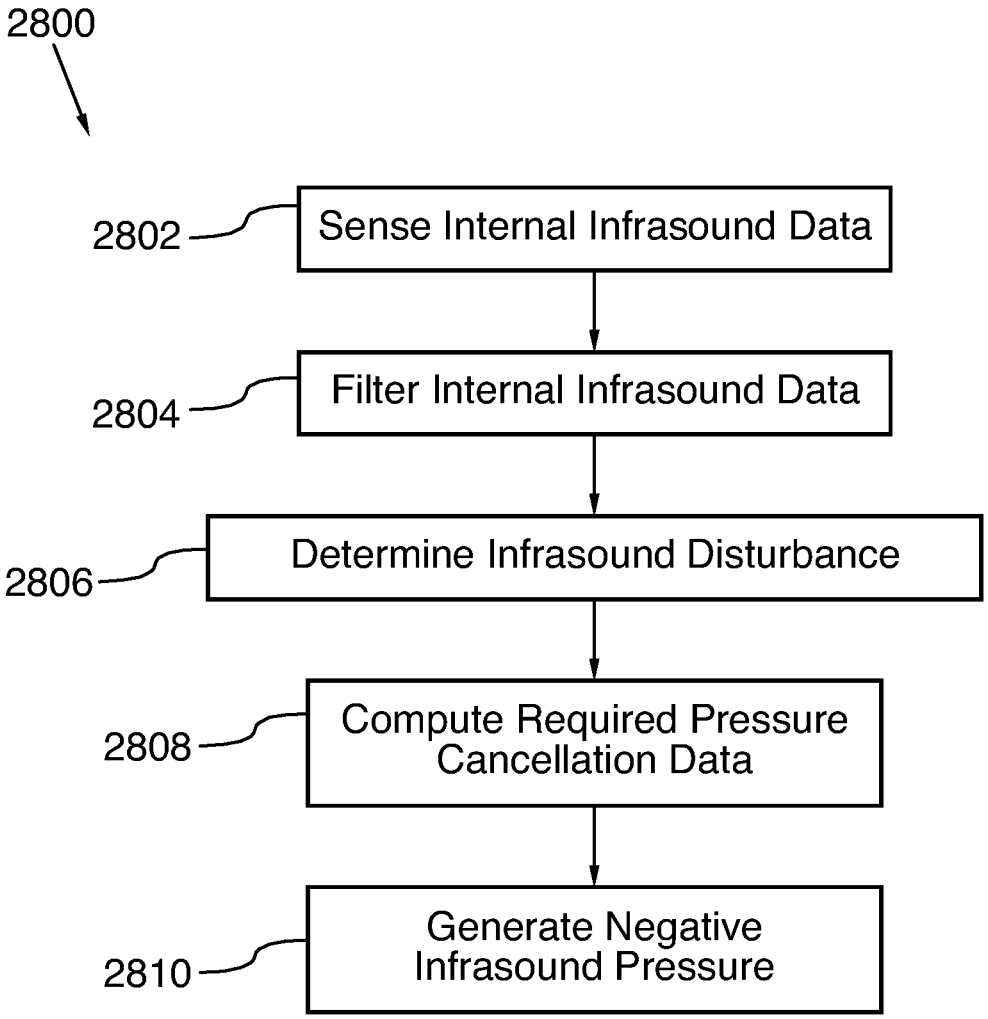
FIG. 28 illustrates a flow diagram of an example method for controlling infrasound, in accordance with an example embodiment.

FIG. 28 illustrates a flow diagram of an example method 2800 for controlling a source of physiological affliction, within a moving enclosed structure, in accordance with an example embodiment. The method 2800 can be implemented by the system 1800 of FIG. 18, in some example embodiments.

At event 2802, the method 2800 includes determining pressure sensor information indicative of the interior 1804 of the structure 1802. At event 2804, the band pass electronic filter(s) 1834 band pass filter specified harmonics from the pressure sensor information.

At event 2806, the method 2800 includes determining, from the filtered pressure sensor information (e.g. at least one or all of the harmonics), at least one infrasound disturbance within the interior 1804 of the structure 1802. This can include "locking" into a periodic or cyclic detected infrasound disruption. At event 2808, the method 2800 includes determining or calculating at least one frequency of infrasound, and associated amplitude, to control the infrasound generator 1816 that will cancel the at least one infrasound disturbance. Reference to at least one frequency includes determining one or more specific frequencies as well as a broadband range of frequencies, such as to regulate the internal pressures from, for example, on or about 0.05 Hz to on or about 20 Hz. In some example embodiments, this is accomplished by applying at least one gain to at least one detected frequency harmonic of infrasound (which can be phase-shifted, if needed). At event 2810, the method 2800 includes applying the determined frequency and amplitude to the infrasound generator 1816, by controlling at least one controllable element 1830 of the infrasound generator 1816 to cancel the at least one infrasound disturbance within the interior 1804 of the structure 1802.

In some example embodiments, reference to controllers includes analog controller devices, digital controller devices, and/or a combination of analog and digital controller devices. At least some of all of the functions of the controller can be performed by a digital microprocessor system and/or digital signal processing (DSP) technology.

In some example embodiments, the described systems and reversible compressors can be used for reducing discomfort or sickness of an occupant within the structure due to an external infrasound source or intrinsic infrasound based on movement of the structure.

In accordance with an example embodiment, there is provided a non-transitory computer-readable medium containing instructions executable by at least one controller device or processor device for performing any or all of the described methods.

In any or all of the described methods, the boxes or algorithm lines may represent events, steps, functions, processes, modules, state-based operations, etc. While some of the examples have been described as occurring in a particular order, it will be appreciated by persons skilled in the art that some of the steps or processes may be performed in a different order provided that the result of the changed order of any given step will not prevent or impair the occurrence of subsequent steps. Furthermore, some of the messages or steps described may be removed or combined in other embodiments, and some of the messages or steps described may be separated into a number of sub-messages or sub-steps in other embodiments. Even further, some or all of the steps may be repeated, as necessary. Elements described as methods or steps similarly apply to systems or subcomponents, and vice-versa. Reference to such words as "sending" or "receiving" could be interchanged depending on the perspective of the particular device.

While some example embodiments have been described, at least in part, in terms of methods, a person of ordinary skill in the art will understand that some example embodiments are also directed to the various components for performing at least some of the aspects and features of the described processes, be it by way of hardware components, software or any combination of the two, or in any other manner. Moreover, some example embodiments are also directed to a pre-recorded storage device or other similar computer-readable medium including program instructions stored thereon for performing the processes described herein. The computer-readable medium includes any non-transient storage medium, such as RAM, ROM, flash memory, compact discs, USB sticks, DVDs, HD-DVDs, or any other such computer-readable memory devices.

Although not specifically illustrated, it will be understood that the devices described herein can include one or more processors or controllers and associated memory. The memory may include one or more application program, modules, or other programming constructs containing computer-executable instructions that, when executed by the one or more processors or controllers, implement the methods or processes described herein.

The various embodiments presented are merely examples and are in no way meant to limit the scope of this disclosure. Variations of the innovations described herein will be apparent to persons of ordinary skill in the art, such variations being within the intended scope of the present disclosure. In particular, features from one or more of the described embodiments may be selected to create alternative embodiments comprised of a sub-combination of features which may not be explicitly described. In addition, features from one or more of the described embodiments may be selected and combined to create alternative embodiments comprised of a combination of features which may not be explicitly described. Features suitable for such combinations and sub-combinations would be readily apparent to persons skilled in the art upon review of the present disclosure as a whole. The subject matter described herein intends to cover and embrace all suitable changes in technology.

The invention claimed is:

1. A two-way flow control device, comprising:

a housing defining a first opening interface and a second opening interface;

a rotor for rotating within the housing, wherein the rotor defines a circumferential reference;

a plurality of blades each mounted to the rotor, each blade controllable to be angled with respect to the circumferential reference in a range of positive and negative blade angles to generate respective positive and negative flows between the first opening interface and the second opening interface;

a first plurality of stator vanes mounted to the housing between the blades and the first opening interface, each including a respective stator vane slope having a stator vane angle with respect to the circumferential reference which are collectively positive or negative angled;

a second plurality of stator vanes mounted to the housing between the blades and the second opening interface, each including a respective stator vane slope having a stator vane angle with respect to the circumferential reference which are collectively opposite angled to the stator vane angles of the first plurality of stator vanes, the second plurality of stator vanes mounted to be circumferentially offset with respect to the first plurality of stator vanes, wherein the first and second plurality of stator vanes further guide both the positive and negative flows;

a respective magnet mounted to each of the blades;

a drive device configured to generate positive and negative current; and an electromagnet controllable by the current from the drive device and positioned to create a positive or negative magnetic field to magnetically interact with the magnets to correspondingly affect the respective blades to the corresponding positive or negative blade angle.

2. The two-way flow control device as claimed in claim 1, wherein at least one or all of the stator vanes includes a respective concave surface which includes the respective stator vane slope.

3. The two-way flow control device as claimed in claim 2, wherein the at least one or all of the stator vanes further include a convex surface at an opposite face to the respective concave surface.

4. The two-way flow control device as claimed in claim 1, wherein at least one of the stator vanes are canted towards the rotor.

5. The two-way flow control device as claimed in claim 1, wherein the first plurality of stator vanes comprise generally mirror image shapes of the second plurality of stator vanes.

6. The two-way flow control device as claimed in claim 1, wherein the first and second plurality of stator vanes are statically mounted to the housing to maintain the respective stator vane angle.

7. The two-way flow control device as claimed in claim 1, wherein the plurality of blades are formed of resilient material to twist in the range of positive and negative blade angles.

8. The two-way flow control device as claimed in claim 1, wherein the plurality of blades are pivotally mounted to the rotor to rotate in the range of positive and negative blade angles.

9. The two-way flow control device as claimed in claim 1, further comprising at least one controller to control the blade angle of the blades at a specified frequency or frequencies.

10. The two-way flow control device as claimed in claim 9, wherein the specified frequency or frequencies include an infrasound frequency or at least lower in frequency than 20 Hertz.

11. The two-way flow control device as claimed in claim 9, wherein the specified frequency or frequencies include an audible frequency between 20 Hertz and 200 Hertz.

12. The two-way flow control device as claimed in claim 9, wherein the at least one controller controls the blade angle of the blades in dependence of a detected pressure value from a pressure sensor.

13. The two-way flow control device as claimed in claim 1, wherein:

a plane of the circumferential reference defines a zero angle reference;

the blade angles are with reference to the zero angle reference;

the stator vane angles of the first plurality of stator vanes and the second plurality of stator vanes are with reference to the zero angle reference.

14. The two-way flow control device as claimed in claim 13, wherein the respective stator vane slopes of the first and second plurality of stator vanes are further collectively opposite angled to each other with respect to a tangential reference plane of the circumferential reference.

15. The two-way flow control device as claimed in claim 13, wherein the respective stator vane slopes of the first and second plurality of stator vanes are curved slopes.

16. The two-way flow control device as claimed in claim 1, wherein the drive device controls the blade angle of the blades at a specified frequency or frequencies.

17. The two-way flow control device as claimed in claim 1, wherein the electromagnet circumferentially surrounds the blades.

18. The two-way flow control device as claimed in claim 1, wherein the respective stator vane angle of the second plurality of stator vanes is generally equal and opposite angled to the respective stator vane angle of the first plurality of stator vanes.

19. The two-way flow control device as claimed in claim 1, further comprising a plurality of tubes positioned at at least one of the first opening interface and the second opening interface and dimensioned to attenuate noise and spinning modes from operation of the blades.

20. The two-way flow control device as claimed in claim 1, wherein the housing comprise a tapering from at least one of the first opening interface and the second opening interface towards the rotor to define a respective flow passage.

21. A two-way compressor comprising the two-way flow control device as claimed in claim 1.

* * * * *